US011282661B2

(12) United States Patent
Donen et al.

(10) Patent No.: US 11,282,661 B2
(45) Date of Patent: Mar. 22, 2022

(54) VACUUM INTERRUPTER

(71) Applicant: Mitsubishi Electric Corporation, Chiyoda-ku (JP)

(72) Inventors: Taiki Donen, Chiyoda-ku (JP); Toshihiko Takematsu, Chiyoda-ku (JP); Satoshi Ochi, Chiyoda-ku (JP); Yuichi Takai, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/040,385

(22) PCT Filed: Mar. 20, 2019

(86) PCT No.: PCT/JP2019/011822
§ 371 (c)(1),
(2) Date: Sep. 22, 2020

(87) PCT Pub. No.: WO2019/188699
PCT Pub. Date: Oct. 3, 2019

(65) Prior Publication Data

US 2021/0057176 A1 Feb. 25, 2021

(30) Foreign Application Priority Data

Mar. 29, 2018 (JP) ..... JP2018-063545

(51) Int. Cl.
*H01H 33/28* (2006.01)
*H01H 33/42* (2006.01)
*H01H 33/666* (2006.01)

(52) U.S. Cl.
CPC ..... *H01H 33/28* (2013.01); *H01H 33/42* (2013.01); *H01H 33/666* (2013.01)

(58) Field of Classification Search
CPC ..... H01H 33/28; H01H 33/42; H01H 33/664; H01H 33/6643; H01H 33/666;
(Continued)

(56) References Cited

U.S. PATENT DOCUMENTS 4,636,600 A 1/1987 Lipperts
5,059,752 A * 10/1991 Inagaki ..... H01H 33/664 218/123
(Continued)

FOREIGN PATENT DOCUMENTS

JP 60-258816 A 12/1985
JP 11-162302 A 6/1999
(Continued)

OTHER PUBLICATIONS

International Search Report dated Jun. 25, 2019 in PCT/JP2019/011822 filed on Mar. 20, 2019.

*Primary Examiner* — William A Bolton
(74) *Attorney, Agent, or Firm* — Xsensus LLP

(57) ABSTRACT

Provided is a small-sized, reliable vacuum interrupter that does not involve upsizing and complication of the reduction load application mechanism. A vacuum interrupter of the present invention includes a magnetic body disposed on a circumferential edge around a stem surface of at least one of a moving current-carrying stem and a fixed current-carrying stem. The magnetic body includes a lower magnetic permeance portion having a lower magnetic permeance than the other portion. The lower magnetic permeance portion produces a magnetic field parallel to the axial direction. Arc discharge is driven in the direction of the parallel magnetic field, thus being extinguished.

18 Claims, 15 Drawing Sheets

(58) Field of Classification Search
CPC ..... H01H 33/6641; H01H 33/6642; H01H 33/6644; H01H 33/6645; H01H 33/6646
USPC ..... 218/118, 123, 126–129, 141, 146
See application file for complete search history.

(56) References Cited

U.S. PATENT DOCUMENTS

| | | | | | |
|---|---|---|---|---|---|
| 5,293,506 | A * | 3/1994 | Yorita | H01H 33/6644 | 218/128 |
| 5,777,287 | A * | 7/1998 | Mayo | H01H 33/6642 | 218/123 |
| 6,479,778 | B1 * | 11/2002 | Kimura | H01H 33/6642 | 218/118 |
| 6,506,992 | B2 * | 1/2003 | Kim | H01H 33/6644 | 218/123 |
| 7,173,208 | B2 * | 2/2007 | Harada | H01H 33/6644 | 218/118 |
| 8,653,396 | B2 * | 2/2014 | Li | H01H 33/6642 | 218/126 |
| 9,040,862 | B2 * | 5/2015 | Ryu | H01H 33/6643 | 218/123 |

FOREIGN PATENT DOCUMENTS

| | | | |
|---|---|---|---|
| JP | 2012-243444 | A | 12/2012 |
| JP | 2014-127280 | A | 7/2014 |

* cited by examiner

VACUUM INTERRUPTER

TECHNICAL FIELD

The present invention relates to a vacuum interrupter having a fixed electrode and a moving electrode in an insulation enclosure maintaining a vacuum to break and connect a circuit.

BACKGROUND ART

A conventional vacuum interrupter serves to interrupt a high current flowing through an electric circuit by switching the state between a fixed electrode and a moving electrode from a closed state to an open state when, for example, an accident occurs. The current interruption causes an arc discharge between the fixed electrode and the moving electrode.

In order to extinguish the arc discharge, each of the fixed electrode and moving electrode has a contact portion protruding relative to the central portion, and slits dividing the contact portion into a plurality of circular segment portions, each slit having one end point adjacent to the central portion and the other end point adjacent to the circumferential edge of the contact portion.

The vacuum interrupter further includes a magnetic body disposed along the surface of and around the circumferential edge of a fixed stem supporting the fixed electrode, and a magnetic body disposed along the surface of and around the circumferential edge of a moving stem supporting the moving electrode.

Such a structure allows a Lorentz force to act on the arc discharge, thereby efficiently driving the arc discharge to rotate along the circumferential edge of the electrodes and extinguishing the arc discharge (PTL 1, for example).

CITATION LIST

Patent Literature

PTL 1: Japanese Patent Laying-Open No. 2014-127280

SUMMARY OF INVENTION

Technical Problem

A conventional vacuum interrupter is designed as shown in FIG. 17. FIG. 17A is a front view of a surface of a moving electrode 101*u* that comes into contact with a fixed electrode 101*d*. FIG. 17B is a front view of a surface of fixed electrode 101*d* that comes into contact with moving electrode 101*u*. In FIG. 17A, moving electrode 101*u* is shown upside down on the drawing sheet, for the sake of clear description of a current flowing from moving electrode 101*u* to fixed electrode 101*d*.

Description will now be given to a current flowing from moving electrode 101*u* to fixed electrode 101*d* in a closed state in which a contact portion 202 of moving electrode 101*u* is in contact with contact portion 202 of fixed electrode 101*d*.

When moving electrode 101*u* is in contact with fixed electrode 101*d*, a current flows through contact portions 202 of moving electrode 101*u* and fixed electrode 101*d*, with no current flowing through central portions 201 of moving electrode 101*u* and fixed electrode 101*d*, since contact portion 202 protrudes relative to central portion 201 in each of moving electrode 101*u* and fixed electrode 101*d*.

In moving electrode 101*u*, a current component Ivu flowing in the direction from top to bottom on the drawing sheet enters contact portion 202 in the vicinity of central portion 201. Current component Ivu then branches off into a current component Icu flowing circumferentially from the center side of moving electrode 101*u*.

Current component Icu flows from contact portion 202 of moving electrode 101*u* to contact portion 202 of fixed electrode 101*d*. This in turn causes a current component Icd flowing through contact portion 202 of fixed electrode 101*d* to the vicinity of central portion 201. Current component Icd then turns into a current component Ivd flowing out of fixed electrode 101*d* in the direction from top to bottom on the drawing sheet.

Current component Icd flowing through fixed electrode 101*d* causes a concentric magnetic flux Md. Likewise, current component Icu flowing through moving electrode 101*u* causes a concentric magnetic flux Mu.

On moving electrode 101*u*, magnetic flux Md forms a circumferential magnetic flux from the central portion 201 side, acting on current component Icu. This causes a Lorentz force Fu acting on moving electrode 101*u* in the direction from bottom to top on the drawing sheet.

Likewise, on fixed electrode 101*d*, magnetic flux Mu forms a circumferential magnetic flux from the central portion 201 side, acting on current component Icd. This causes a Lorentz force Fd acting on fixed electrode 101*d* in the direction from top to bottom on the drawing sheet.

That is, in a conventional vacuum interrupter, when a current is carried through the fixed stem and the moving stem while the interrupter is in a closed state, Lorentz forces act on fixed electrode 101*d* and moving electrode 101*u*, thereby causing a repulsive force in the direction toward an open state.

In order to prevent unintended separation between the fixed electrode and the moving electrode, the application of load (hereinafter referred to as "contact load") is required. Accordingly, a conventional vacuum interrupter, which entails a repulsive force in the direction toward an open state, involves an increased contact load and upsizing and complication of the load application mechanism.

If contact portion 202 does not protrude relative to central portion 201 but is flush with central portion 201 in each of the fixed electrode and moving electrode, an arc discharge may occur in the vicinity of central portion 201 at the time of interruption operation when the vacuum interrupter switches from a closed state to an open state. Such an arc discharge occurring in the vicinity of central portion 201 is not acted on by a Lorentz force and thus cannot be extinguished.

The present invention has been made to solve a problem of upsizing and complication of the load application mechanism as described above. An object of the present invention is to provide a fixed electrode, a moving electrode, and their surrounding structures that can reduce the repulsive force.

Solution to Problem

A vacuum interrupter of the present invention includes a magnetic body disposed on a circumferential edge around a stem surface of at least one of a moving current-carrying stem and a fixed current-carrying stem. The magnetic body includes a lower magnetic permeance portion having a lower magnetic permeance than the other portion.

Advantageous Effects of Invention

The present invention can provide a small-sized, reliable vacuum interrupter without involving upsizing and complication of the reduction load application mechanism.

DESCRIPTION OF EMBODIMENTS

Embodiment 1

Embodiment 1 of the present invention will now be described in detail with reference to FIGS. 1 to 12.

Figure 1:
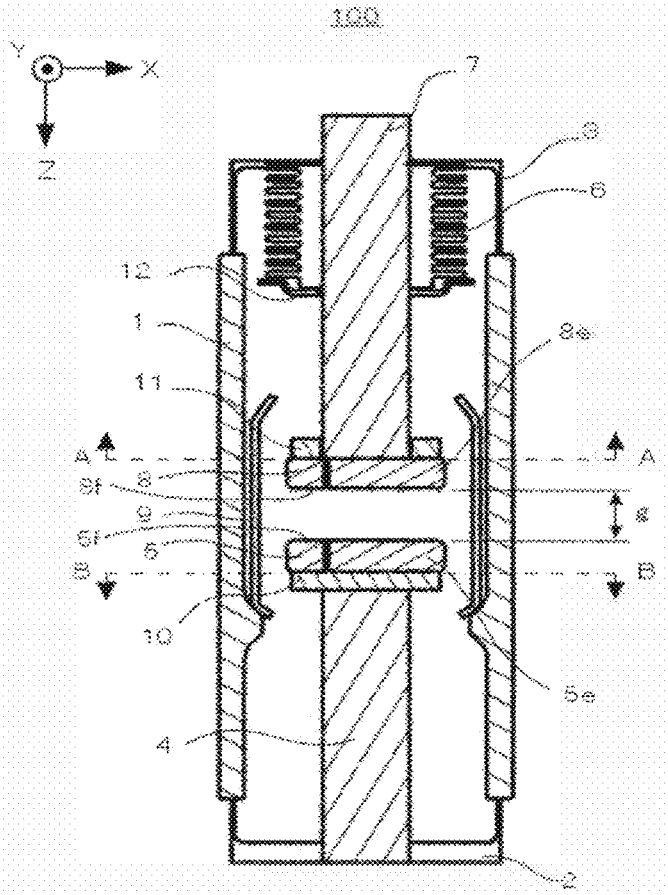
FIG. 1 is a cross-sectional view of a vacuum interrupter 100 in embodiment 1 of the present invention.
Figure 2:
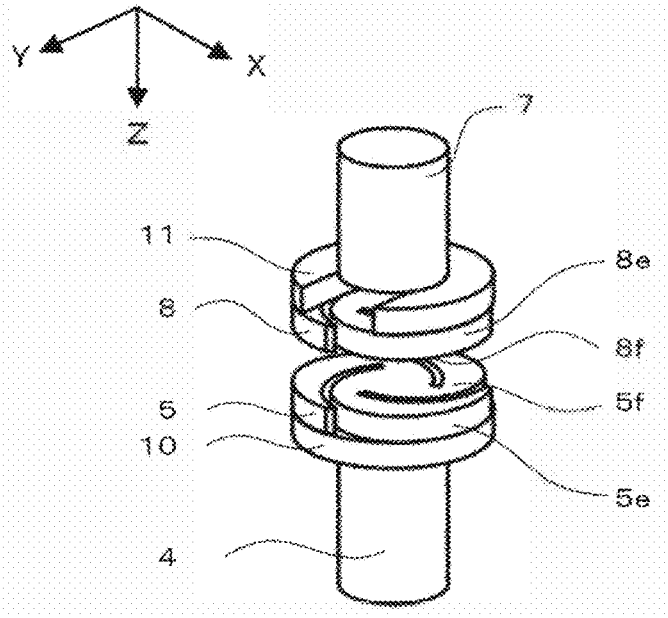
FIG. 2 is a perspective view illustrating a part including a fixed electrode 5, a moving electrode 8, and their surrounding area of vacuum interrupter 100.

First, with reference to FIGS. 1 to 3, a configuration of a vacuum interrupter 100 in embodiment 1 is described.

FIG. 1 is a cross-sectional view of vacuum interrupter 100 in embodiment 1 for practicing the present invention. FIG. 2 is a perspective view illustrating a part including a fixed electrode 5, a moving electrode 8, and their surrounding area of vacuum interrupter 100. FIG. 3 shows front views illustrating a part including fixed electrode 5, moving electrode 8, and their surrounding area of vacuum interrupter 100.

In FIG. 1, the Y direction indicated by an arrow defines the direction from the back side to the front side on FIG. 1 sheet; the X direction indicated by an arrow defines the direction from left to right on FIG. 1 sheet; and the Z direction indicated by an arrow defines the direction from top to bottom on FIG. 1 sheet. The X, Y, and Z directions indicated by arrows in FIGS. 2 and 3 define the same directions as the X, Y, and Z directions in FIG. 1.

Also, where X, Y, and Z directions are defined in FIGS. 4 to 15 and 18 to 26, the X, Y, and Z directions define the same as those in FIG. 1.

With reference to FIGS. 1 and 2, a cylindrical insulation enclosure 1 is made of an insulating member, such as ceramic. Insulation enclosure 1 has a moving end plate 3 at its one end. Insulation enclosure 1 has a fixed end plate 2 at its other end.

A bellows 6, flexible in the Z direction, is attached to moving end plate 3 at one end of bellows 6. Bellows 6 has the other end having a bellows shield 12 attached thereto. Further, a moving current-carrying stem 7 is attached passing through bellows shield 12. Moving current-carrying stem 7 has moving electrode 8 at its end.

Moving end plate 3, bellows 6, bellows shield 12, moving current-carrying stem 7, and moving electrode 8 are electrically connected. Further, a solid part of a moving magnetic body 11 is disposed on the circumferential edge around the stem surface of moving current-carrying stem 7.

A fixed current-carrying stem 4 is attached to fixed end plate 2, such that fixed current-carrying stem 4 lies on an extension of the axis of moving current-carrying stem 7 and passes through fixed end plate 2. Fixed current-carrying stem 4 has fixed electrode 5 at its end.

Fixed end plate 2, fixed current-carrying stem 4, and fixed electrode 5 are electrically connected. Further, a solid part of a fixed magnetic body 10 is disposed on the circumferential edge around the stem surface of fixed current-carrying stem 4.

A contact surface 5*f* of fixed electrode 5 faces a contact surface 8*f* of moving electrode 8. The distance between contact surface 5*f* of fixed electrode 5 and contact surface 8*f* of moving electrode 8 is denoted as an inter-electrode distance g. The maximum value of inter-electrode distance g is denoted as a maximum distance gmax, which indicates the maximum value in the movable range of moving current-carrying stem 7.

Insulation enclosure 1 contains an arc shield 9 therein made of a conductive member, such as metal. Arc shield 9 covers fixed electrode 5 and moving electrode 8. When an arc discharge occurs between moving electrode 8 and fixed electrode 5, arc shield 9 can protect other regions from the metal vapor and metal particles scattering from moving electrode 8 and fixed electrode 5 due to the heat from arc discharge.

With reference to FIG. 3, the structure of fixed electrode 5, moving electrode 8, and their surrounding area of vacuum interrupter 100 will now be described in detail.

Figure 3A:
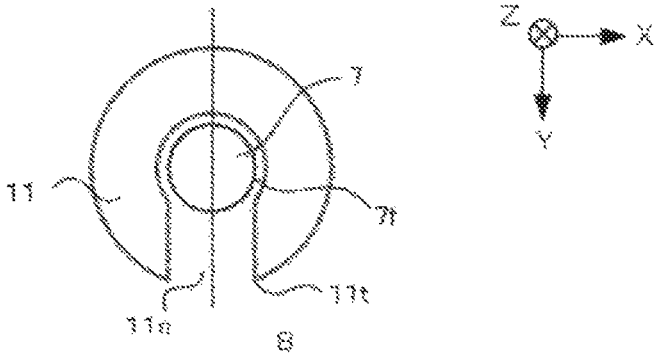
FIG. 3A shows front view illustrating a part around fixed electrode 5 and moving electrode 8 in vacuum interrupter 100.
Figure 3B:
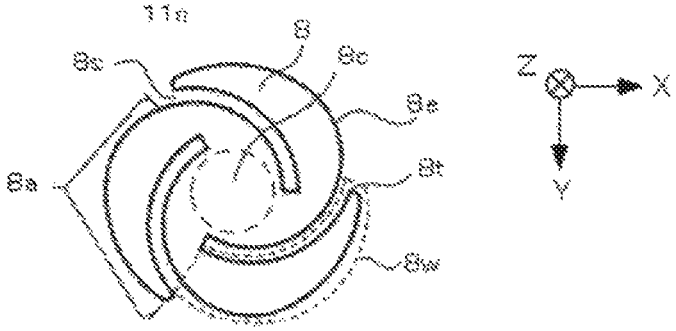
FIG. 3B shows a front view illustrating a part including moving electrode 8 in vacuum interrupter 100.
Figure 3C:
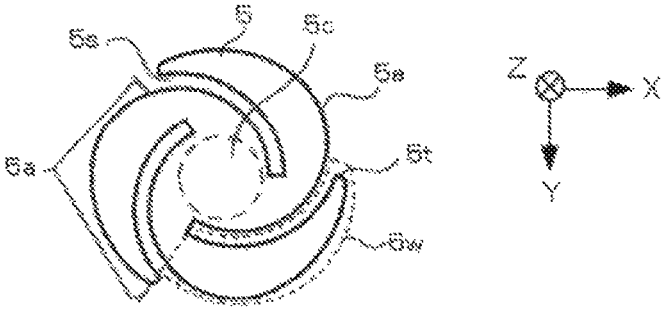
FIG. 3C shows a front view illustrating a part including fixed electrode 5 in vacuum interrupter 100.
Figure 3D:
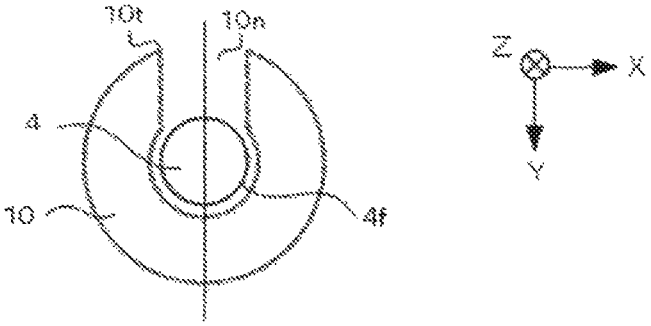
FIG. 3D shows a front view illustrating a part around fixed electrode 5 and moving electrode 8 in vacuum interrupter 100.

FIG. 3A is a front view at the connection between moving electrode 8 and moving current-carrying stem 7, taken along broken line A-A shown in FIG. 1. The Y direction is reversed to align with a later-described drawing with a current direction. FIG. 3B is a front view of contact surface 8*f* of moving electrode 8, with the Y direction also reversed. FIG. 3C is a front view of contact surface 5*f* of fixed electrode 5. FIG. 3D is a front view at the connection between fixed electrode 5 and fixed current-carrying stem 4 taken along broken line B-B shown in FIG. 1.

With reference to FIG. 3A, a solid part of moving magnetic body 11 is disposed on the circumferential edge around a stem surface 7*f* of moving current-carrying stem 7. Moving magnetic body 11 has a notch 11*n*, a partial cut-out in the solid part. Moving magnetic body 11 has a tip 11*t* located at the end, on the outer peripheral side, of the boundary between the solid part and notch 11*n*.

With reference to FIG. 3B, moving electrode 8 has slits 8*s* each having one end point adjacent to a central portion 8*c* indicated by a broken line, and having the other end point adjacent to an edge portion 8*e*. Slits 8*s* divide the outer periphery of moving electrode 8 into a plurality of circular segment portions 8*a*. The regions defined by slits 8*s* and circular segment portions 8*a*, one of which is enclosed by a dotted line in the drawing, are referred to as wings 8*w*. Each wing 8*w* has a tip 8*t*, which is the end of wing 8*w* on the outer peripheral side. In other words, slits 8*s* divide the region on the edge portion 8*e* side relative to central portion 8*c*, into a plurality of wings 8*w*.

In embodiment 1, moving electrode 8 has three slits 8*s* dividing the outer periphery of moving electrode 8 into three parts, thus creating three circular segment portions 8*a* and three wings 8*w*.

With reference to FIG. 3C, fixed electrode 5 has slits 5*s* each having one end point adjacent to a central portion 5*c* indicated by a broken line, and having the other end point adjacent to an edge portion 5*e*. Slits 5*s* divide the outer periphery of fixed electrode 5 into a plurality of circular segment portions 5*a*. The regions defined by slits 5*s* and circular segment portions 5*a*, one of which is enclosed by a dotted line in the drawing, are referred to as wings 5*w*. Each wing 5*w* has a tip 5*t*, which is the end of wing 5*w* on the outer peripheral side. In other words, slits 5*s* divide the region on the edge portion 5*e* side relative to central portion 5*c*, into a plurality of wings 5*w*.

In embodiment 1, fixed electrode 5 has three slits 5*s* dividing the outer periphery of fixed electrode 5 into three parts, thus creating three circular segment portions 5*a* and three wings 5*w*.

With reference to FIG. 3D, a solid part of fixed magnetic body 10 is disposed on the circumferential edge around a stem surface 4*f* of fixed current-carrying stem 4. Fixed magnetic body 10 has a notch 10*n*, a partial cut-out in the solid part. Fixed magnetic body 10 has a tip 10*t* located at the end, on the outer peripheral side, of the boundary between the solid part and notch 10*n*.

In embodiment 1, notch 11*n* of moving magnetic body 11 is 180 degrees rotationally displaced from notch 10*n* of fixed magnetic body 10 around the Z direction.

The operation of vacuum interrupter 100 will now be described.

The inside of vacuum interrupter 100 is kept at a vacuum of $1\times10^{-3}$ Pa or less so as to maintain a high vacuum. Switching can be made between a closed state in which moving electrode 8 is connected to fixed electrode 5, and an open state in which moving electrode 8 is separated from fixed electrode 5.

FIG. 1 is an open state in which moving electrode 8 is not connected to fixed electrode 5. In other words, it is a state in which contact surface 8*f* is not in contact with contact surface 5*f*.

When a pressure is externally applied to moving current-carrying stem 7 in the Z direction, moving current-carrying stem 7 moves to create a closed state in which moving electrode 8 is connected to fixed electrode 5. In other words, it is a state in which contact surface 8*f* is in contact with contact surface 5*f*.

That is, a movement of moving current-carrying stem 7 can switch from an open state to a closed state, or from a closed state to an open state.

With reference to FIGS. 4 to 10, the mechanism to extinguish an arc discharge occurring at the time of interruption operation will now be described.

Figure 4A:
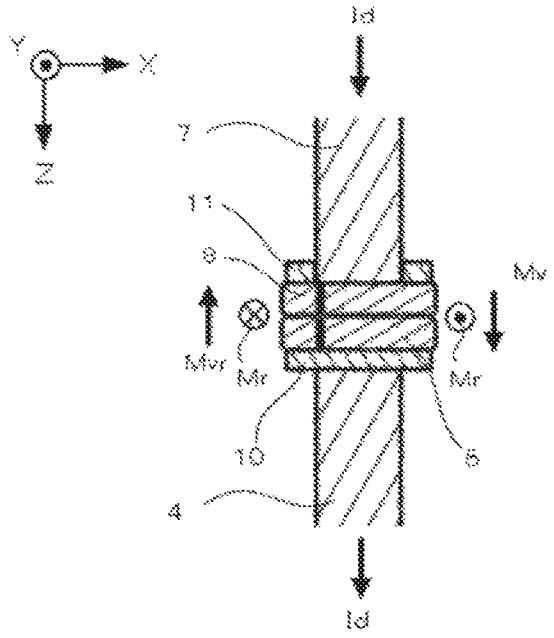
FIG. 4A shows a cross-sectional view illustrating a part including fixed electrode 5, moving electrode 8, and their surrounding area of vacuum interrupter 100 in a closed state.
Figure 4B:
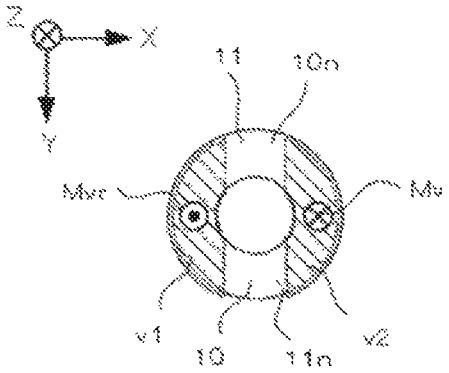
FIG. 4B shows a front view illustrating a layout of a moving magnetic body 11 and a fixed magnetic body 10.
Figure 5:
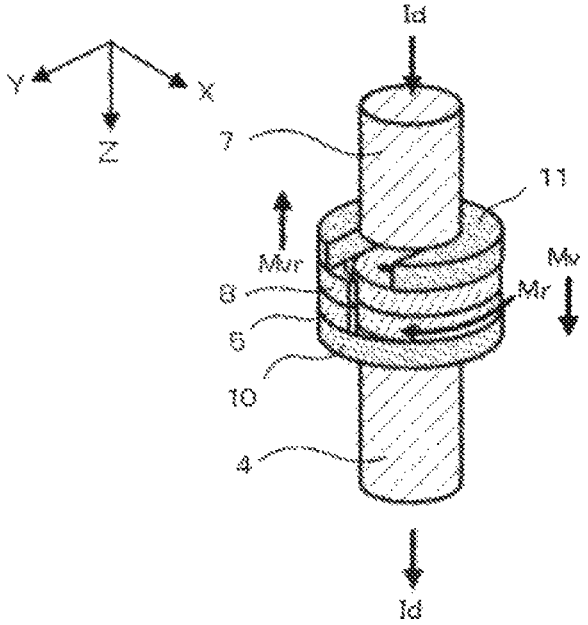
FIG. 5 is a perspective view illustrating a part including fixed electrode 5, moving electrode 8, and their surrounding area of vacuum interrupter 100 in a closed state.

First, with reference to FIGS. 4 to 6, description is given to the paths of current and the magnetic fields generated from the current in vacuum interrupter 100 in a closed state.

FIG. 4 shows a cross-sectional view illustrating a part including fixed electrode 5, moving electrode 8, and their surrounding area of vacuum interrupter 100 in a closed state; and a front view illustrating a layout of moving magnetic body 11 and fixed magnetic body 10.

FIG. 4A is a cross-sectional view seen from the same direction as the cross-section shown in FIG. 1, with the directions of a current Id, a magnetic flux Mr, and leakage fluxes Mv and Mvr added therein.

FIG. 4B shows a layout of moving magnetic body 11 and fixed magnetic body 10 as seen from front in the Z direction, with the directions of leakage fluxes Mv and Mvr added therein.

The regions where the solid part of moving magnetic body 11 overlaps with the solid part of fixed magnetic body 10 are denoted as regions v1 and v2, which are located between moving magnetic body 11 and fixed magnetic body 10.

FIG. 5 is a perspective view illustrating a part including fixed electrode 5, moving electrode 8, and their surrounding area of vacuum interrupter 100 in a closed state, with the directions of current Id, magnetic flux Mr, and leakage fluxes Mv and Mvr added therein.

FIG. 6, similar to FIG. 3, shows front views illustrating a part including fixed electrode 5, moving electrode 8, and their surrounding area of vacuum interrupter 100, with the directions of current Id, magnetic flux Mr, and leakage fluxes Mv, Mvr, and Mp added therein.

Figure 6A:
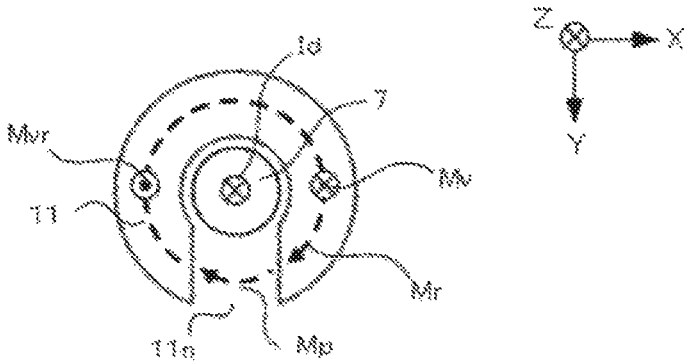
FIG. 6A shows a front view illustrating a part around fixed electrode 5 and moving electrode 8 in vacuum interrupter 100.
Figure 6B:
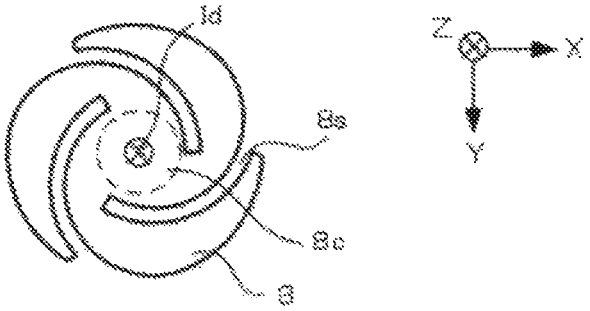
FIG. 6B shows a front view illustrating a part including moving electrode 8 in vacuum interrupter 100.
Figure 6C:
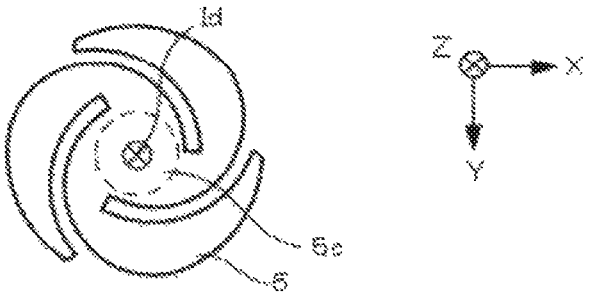
FIG. 6C shows a front view illustrating a part including fixed electrode 5 in vacuum interrupter 100.
Figure 6D:
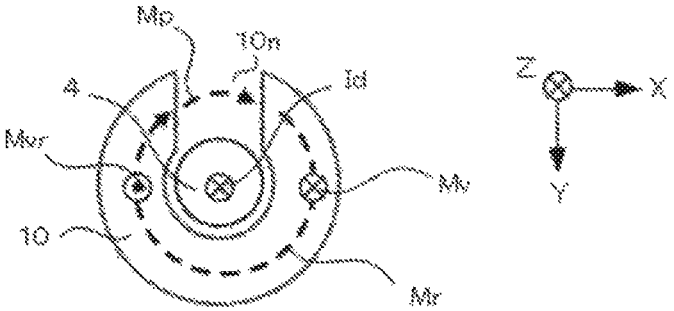
FIG. 6D shows a front view illustrating a part around fixed electrode 5 and moving electrode 8 in vacuum interrupter 100.

FIG. 6A, similar to FIG. 3A, shows a front view at the connection between moving electrode 8 and moving current-carrying stem 7, with the directions of current Id, magnetic flux Mr, and leakage fluxes Mv, Mvr, and Mp added therein. FIG. 6B, similar to FIG. 3B, shows a front view of moving electrode 8, with the direction of current Id added therein. FIG. 6C, similar to FIG. 3C, is a front view of fixed electrode 5, with the direction of current Id added therein. FIG. 6D, similar to FIG. 3D, is a front view at the connection between fixed electrode 5 and fixed current-carrying stem 4, with the directions of current Id, magnetic flux Mr, and leakage fluxes Mv, Mvr, and Mp added therein.

Vacuum interrupter 100 is in a closed state, with current Id flowing from moving current-carrying stem 7 to fixed current-carrying stem 4. That is, current Id is flowing in the Z direction.

Since contact surface 8*f* of moving electrode 8 is in contact with contact surface 5*f* of fixed electrode 5 over the whole surface, current Id mainly flows from central portion 8*c* of moving electrode 8 through central portion 5*c* of fixed electrode 5.

That is, as compared with a conventional vacuum interrupter (described in PTL 1), current Id has no or little current component flowing through wings 8*w* and wings 5*w*. This reduces a repulsive force in the direction toward an open state between fixed electrode 5 and moving electrode 8.

Magnetic fluxes caused by a magnetomotive force from current Id will now be described.

First, current Id causes concentric magnetic fluxes around moving current-carrying stem 7 and fixed current-carrying stem 4. Among the magnetic fluxes, magnetic flux Mr is circulating through moving magnetic body 11 and fixed magnetic body 10.

Notch 11*n* of moving magnetic body 11 causes leakage fluxes. The leakage fluxes include: leakage flux Mp in the same direction as magnetic flux Mr; leakage flux Mv in the direction from moving electrode 8 to fixed current-carrying stem 4; and leakage flux Mvr in the direction from fixed current-carrying stem 4 to moving electrode 8.

Similarly, notch 10*n* of fixed magnetic body 10 causes leakage fluxes. The leakage fluxes include: leakage flux Mp in the same direction as magnetic flux Mr; leakage flux Mv in the direction from moving electrode 8 to fixed current-carrying stem 4; and leakage flux Mvr in the direction from fixed current-carrying stem 4 to moving electrode 8.

Leakage flux Mv mainly passes through region v2, whereas leakage flux Mvr mainly passes through region v1.

With reference to FIGS. 7A to 10, the mechanism will now be described for extinguishing an arc discharge occurring between contact surface 5*f* and contact surface 8*f* when vacuum interrupter 100 makes an interruption operation with current Id flowing.

Figure 7A:
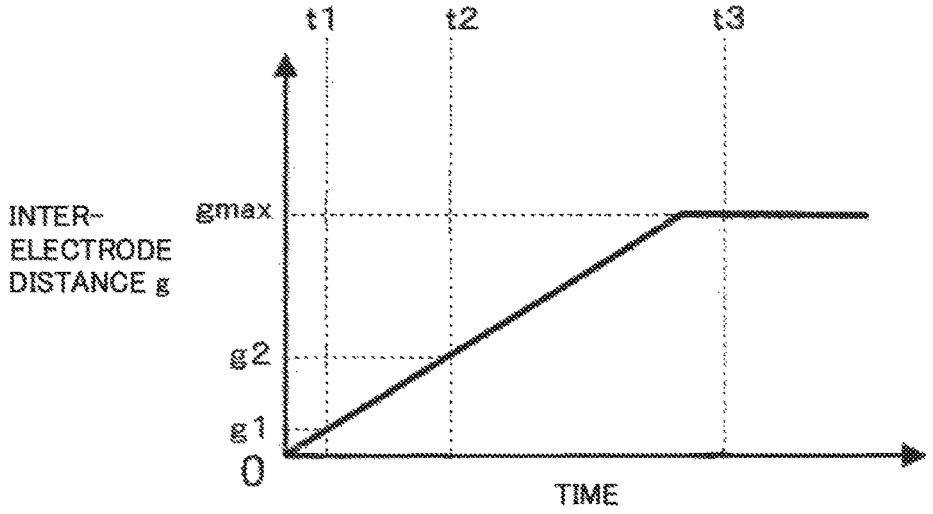
FIG. 7A shows a graph illustrating the temporal variations of parameters at the time of interruption operation of vacuum interrupter 100.
Figure 7B:
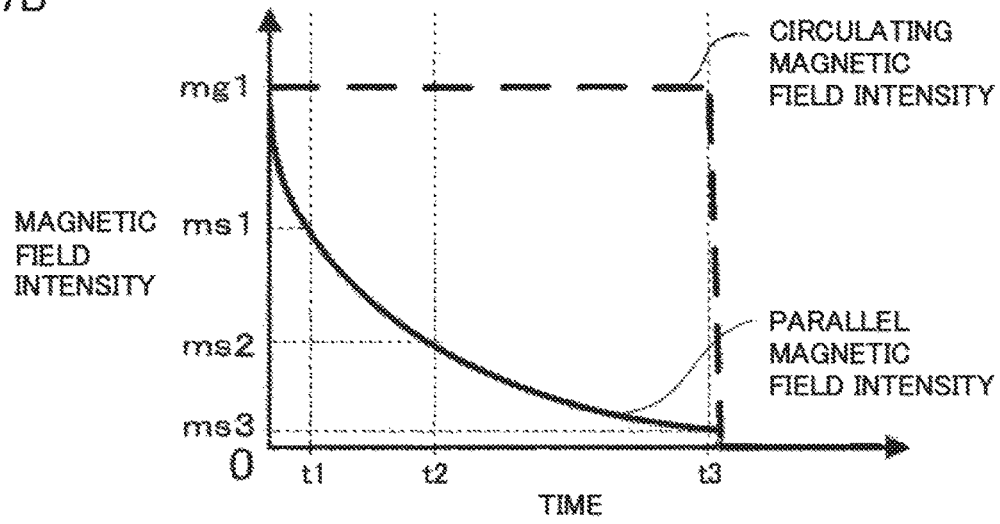
FIG. 7B shows a graph illustrating the temporal variations of parameters at the time of interruption operation of vacuum interrupter 100.

FIG. 7A and FIG. 7B show graphs illustrating the temporal variations of parameters at the time of interruption operation of vacuum interrupter 100.

FIG. 7A shows the temporal variation of inter-electrode distance g.

A magnetic field caused by leakage fluxes Mv and Mvr is defined as a parallel magnetic field. The average of the absolute values of the magnetic field intensities caused by leakage fluxes Mv and Mvr is defined as a parallel magnetic field intensity.

A magnetic field caused by magnetic flux Mr circulating inside moving magnetic body 11 or fixed magnetic body 10 is defined as a circulating magnetic field. The average of the absolute values of the intensities caused by magnetic flux Mr is defined as a circulating magnetic field intensity.

FIG. 7B shows the temporal variations of the parallel magnetic field intensity and the circulating magnetic field intensity.

At the zero time, vacuum interrupter 100 is in a closed state. Vacuum interrupter 100 then makes a mechanical operation of moving current-carrying stem 7.

When inter-electrode distance g reaches maximum distance gmax, the mechanical operation of moving current-carrying stem 7 is completed.

Meanwhile, an arc discharge occurs between contact surface 5*f* of fixed electrode 5 and contact surface 8*f* of moving electrode 8, which is then extinguished at time t3, thus annihilating the parallel magnetic field and the circulating magnetic field.

An arc discharge occurs at the point at which contact surface 8*f* is separated from contact surface 5*f* at the last moment in the interruption operation. Specifically, an arc discharge may occur at any position on contact surface (5*f*, 8*f*), according to the effect of microscopic asperities on contact surfaces 5*f* and 8*f*.

If contact portion 202 does not protrude relative to central portion 201 but is flush with central portion 201 in each of the fixed electrode and moving electrode as in a conventional vacuum interrupter (described in PTL 1), an arc discharge occurring at central portion 201 cannot be extinguished, as described above.

The mechanism for extinguishing an arc discharge will now be described. In the description, an arc discharge is assumed to occur at central portion (8*c*, 5*c*) since the present invention can effectively extinguish an arc discharge occurring at central portion (8*c*, 5*c*) at the time of interruption operation.

FIG. 8 shows front views illustrating the states of arc discharge on contact surface 5*f* of fixed electrode 5 of vacuum interrupter 100 at the time of interruption operation. Similarly, FIG. 9 shows perspective views illustrating the states of arc discharge of fixed electrode 5 and moving electrode 8 at the time of interruption operation.

Figure 8A:
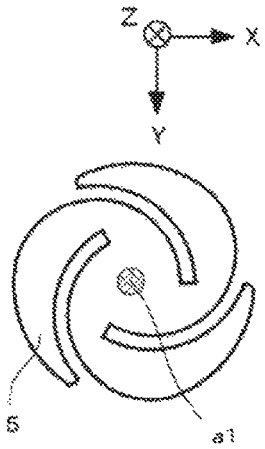
FIG. 8A shows a front view illustrating the states of arc discharge on a contact surface 5*f* of fixed electrode 5 of vacuum interrupter 100 at the time of interruption operation.
Figure 8B:
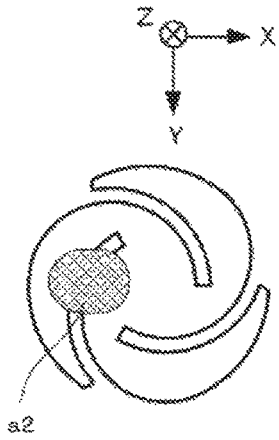
FIG. 8B shows a front view illustrating the states of arc discharge on a contact surface 5*f* of fixed electrode 5 of vacuum interrupter 100 at the time of interruption operation.
Figure 8C:
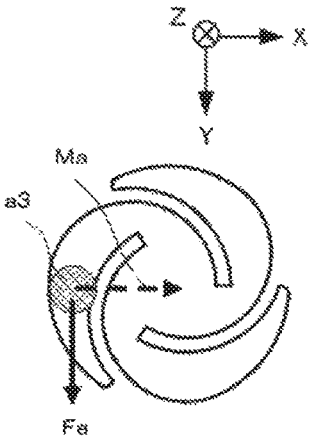
FIG. 8C shows a front view illustrating the states of arc discharge on a contact surface 5*f* of fixed electrode 5 of vacuum interrupter 100 at the time of interruption operation.
Figure 9A:
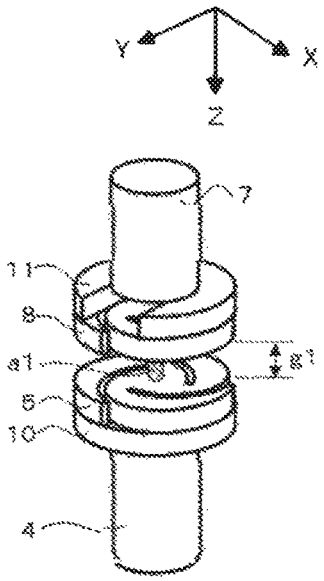
FIG. 9A shows a perspective view illustrating the states of arc discharge at the time of interruption operation of vacuum interrupter 100.
Figure 9B:
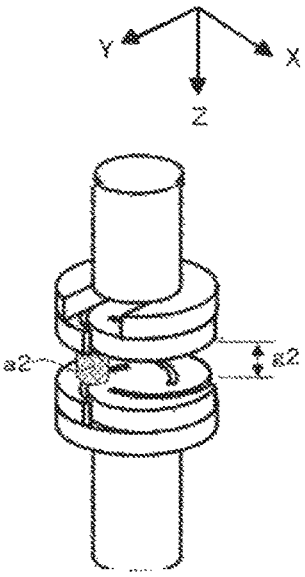
FIG. 9B shows a perspective view illustrating the states of arc discharge at the time of interruption operation of vacuum interrupter 100.
Figure 9C:
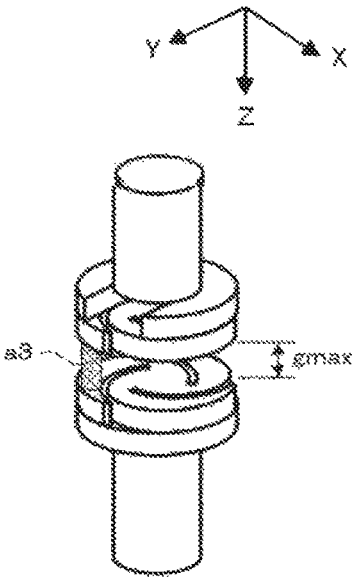
FIG. 9C shows a perspective view illustrating the states of arc discharge at the time of interruption operation of vacuum interrupter 100.

FIGS. 8A and 9A show the state at time t1 shown in FIG. 7A and FIG. 7B, FIGS. 8B and 9B show the state at time t2 shown in FIG. 7A and FIG. 7B, and FIGS. 8C and 9C show the state at time t3 shown in FIG. 7B.

Figure 10:
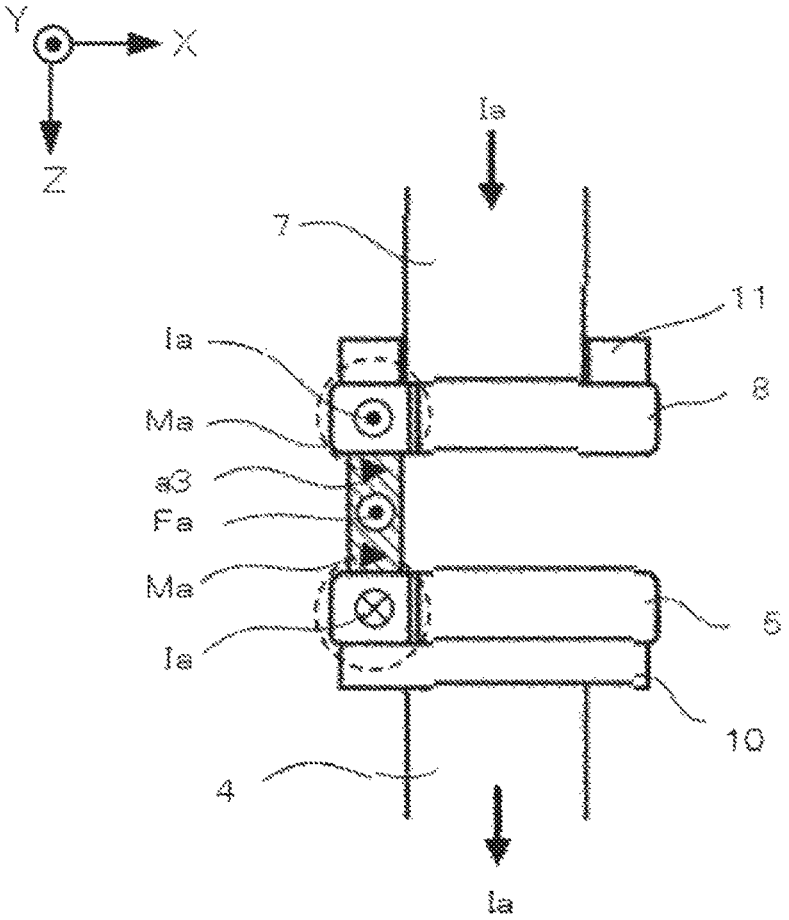
FIG. 10 is a cross-sectional view illustrating a part including fixed electrode 5, moving electrode 8, and their surrounding area of vacuum interrupter 100 to describe the directions of current and magnetic flux.

FIG. 10 is a cross-sectional view illustrating a part including fixed electrode 5, moving electrode 8, and their surrounding area of vacuum interrupter 100, with the directions of a current Ia, a magnetic flux Ma, and a Lorentz force Fa added therein to describe the directions of current and magnetic flux after an arc discharge moves to wings 5*w*.

With reference to FIGS. 7A, 7B, 8A, and 9A, at time t1 immediately after the start of interruption operation, an arc discharge a1 from central portion 8*c* to central portion 5*c* has already occurred.

Since the magnetic permeance does not change inside fixed electrode 5 and moving electrode 8, the circulating magnetic field intensity remains almost unchanged.

As inter-electrode distance g is increased, the magnetic permeance between moving magnetic body 11 and fixed magnetic body 10 is decreased, thereby attenuating the parallel magnetic field intensity from the initial intensity to a magnetic field intensity value of ms1. Meanwhile, the circulating magnetic field intensity maintains a relatively high magnetic field intensity value of mg1.

With reference to FIGS. 7A, 7B, 8B, and 9B, at time t2 after a lapse of a certain period of time from time t1, arc discharge a1 diffuses while moving from central portion 5*c* to wings 5*w*, thereby increasing its cross-sectional area (i.e., the area on contact surface 5*f*) as indicated by an arc discharge a2.

Such a change, peculiar to an arc discharge in a vacuum, is due to the property of arc discharge of moving to a place having a higher intensity of magnetic field parallel to the discharge current (parallel magnetic field). This phenomenon is considered to be because the charged particles (ions and electrons) of arc discharge move helically winding around a magnetic flux.

In other words, in embodiment 1, since regions v1 and v2 shown in FIG. 4(*b*) have a high parallel magnetic field intensity, arc discharge a1 moves to region v1 or v2.

The behavior of arc discharge a1 after moving to regions v1 and v2 and the mechanism of arc extinguishing depend on the magnitude of current Id to be interrupted.

Firstly, description is given to a behavior of arc discharge with a low current Id to be interrupted.

An arc discharge in a vacuum trapped by a parallel magnetic field diffuses over the whole surface of regions v1 and v2, which have a high parallel magnetic field intensity. Thus, the arc discharge is maintained at a lower current density than in no parallel magnetic field. Arc discharge a2 therefore does not cause an excessive temperature rise of fixed electrode 5 and moving electrode 8. Arc discharge a2 is thus extinguished while remaining diffused over the whole surface of regions v1 and v2. In this case, fixed electrode 5 and moving electrode 8 do not experience an excessive temperature rise and thus exhibit very little wear.

Secondly, description is given to a behavior of arc discharge with a high current Id to be interrupted.

An increase in current causes an increase in magnetomotive force, thereby increasing the magnetic flux density of circulating magnetic field flowing through fixed magnetic body 10 and moving magnetic body 11. When the magnetic flux density exceeds the saturated magnetic flux density intrinsic in the material of fixed magnetic body 10 and moving magnetic body 11, magnetic saturation is reached. This significantly decreases the magnetic permeability of fixed magnetic body 10 and moving magnetic body 11.

In this case, the magnetic flux is likely to move along the path passing through notch 11*n* and circulating through the same magnetic body, thus decreasing the intensities of leakage fluxes My and Mvr. That is, the parallel magnetic field intensity attenuates. Accordingly, arc discharge a2, which has been diffused over regions v1 and v2, cannot maintain the diffused state, thus moving to wings 5*w* as indicated by an arc discharge a3 in FIG. 8C and shifting to a state of high current density.

With reference to FIGS. 7A, 7B, 8C, and 9C, arc discharge a3 will now be described in detail.

At time t3 after a lapse of a certain period of time from time t2, arc discharge a2 moves to wings 5*w* as indicated by arc discharge a3.

With reference to FIG. 10, current Ia caused by arc discharge a3 flows from moving current-carrying stem 7 to fixed current-carrying stem 4 as before the interruption operation.

When arc discharge a3 lies in wings 5*w*, current Ia flows in the direction along wings 8*w* of moving electrode 8. For the sake of brevity, the direction of current Ia along wings 8*w* is described as substantially coinciding with the Y direction.

Current Ia flows between moving electrode 8 and fixed electrode 5 as arc discharge a3, and then flows in the direction along wings 5*w* to reach fixed current-carrying stem 4. For the sake of brevity, the direction of current Ia along wings 8*w* is described as substantially coinciding with the direction opposite to the Y direction.

When flowing through wings 8*w* of moving electrode 8 in the Y direction, current Ia causes a concentric magnetic flux Ma around the direction of current Ia. Similarly, when flowing through wings 5*w* of fixed electrode 5 in the direction opposite to the Y direction, current Ia causes concentric magnetic flux Ma around the direction of current Ia. These magnetic fluxes are X-direction magnetic fluxes in the vicinity of arc discharge a3.

Further, Lorentz force Fa in the Y direction is applied to arc discharge a3. With Lorentz force Fa, arc discharge a3 circulates on contact surface 8*f* of moving electrode 8 and on contact surface 5*f* of fixed electrode 5, thereby being cooled and extinguished.

That is, arc discharge a1 originally generated at the central portion (8*c*, 5*c*) circumferentially diffuses by the action of the parallel magnetic field parallel to the discharge direction.

When current Id is low, the action of the parallel magnetic field continues and maintains the diffusion with low current density. This can curb a temperature rise of fixed electrode 5 and moving electrode 8, thus allowing arc discharge a2 to be extinguished.

When current Id is high, the parallel magnetic field cannot be maintained due to the magnetic saturation of the magnetic bodies, resulting in arc discharge a2 moving to wings 5*w* and then changing into a high current density state. However, due to Lorentz force Fa, produced by magnetic fluxes generated by current Ia flowing through moving electrode 8 and fixed electrode 5, arc discharge a2 circulates on contact surface 8*f* of moving electrode 8 and on contact surface 5*f* of fixed electrode 5, thereby being cooled and extinguished.

Since Lorentz force Fa acts due to current Ia in the direction along the wings (8*w*, 5*w*), Lorentz force Fa actually acts on arc discharge a3 in the direction rotating around a Z direction axis. For the sake of brevity, at times t1 to t3, the arc discharge, acted on by Lorentz force Fa, also moves in the direction rotating around a Z-direction axis.

As described above, vacuum interrupter 100 in embodiment 1 can, in a closed state, reduce a repulsive force in the direction toward an open state between fixed electrode 5 and moving electrode 8. This can prevent upsizing and complication of the load application mechanism.

Further, at the time of interruption operation, vacuum interrupter 100 can quickly extinguish arc discharge a1 occurring between fixed electrode 5 and moving electrode 8.

That is, according to embodiment 1, a small-sized, reliable vacuum interrupter can be provided.

With reference to FIG. 11, a preferred example of embodiment 1 will now be described.

Figure 11A:
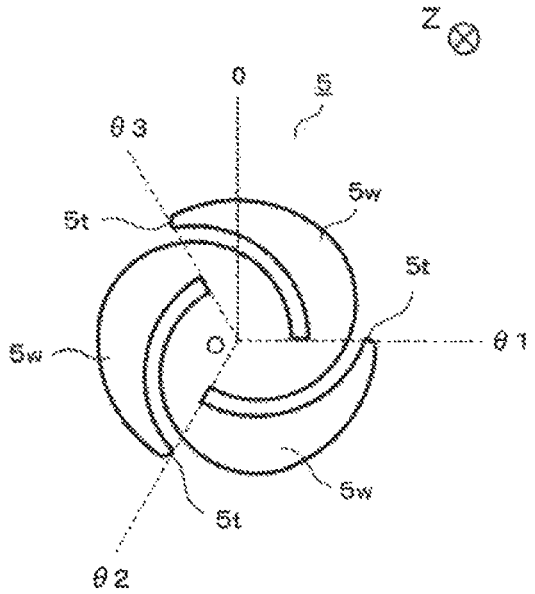
FIG. 11A shows a front view of fixed electrode 5 in a preferred example of embodiment 1.
Figure 11B:
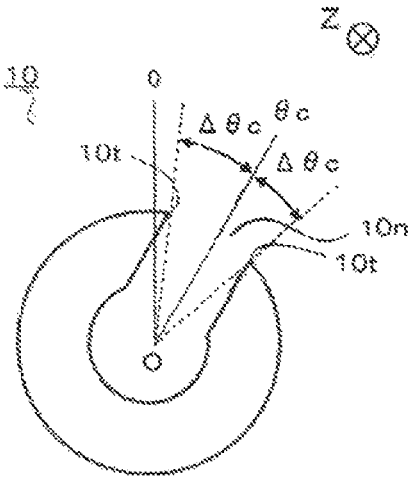
FIG. 11B shows a front view of fixed electrode 5 in a preferred example of embodiment 1.

FIG. 11 shows front views illustrating angles of rotation of fixed electrode 5 and fixed magnetic body 10. FIG. 11A shows the front of fixed electrode 5, where the center of fixed electrode 5 is defined as an origin O and where the clockwise angles with respect to the reference axis extending upward from origin O on the drawing sheet are defined as positive angles. Similarly, FIG. 11B shows the front of fixed magnetic body 10, where the clockwise angles with respect to the reference axis, the same as that of FIG. 11B, are defined as positive angles.

With reference to FIG. 11A, fixed electrode 5 has three wings 5*w*, as described above.

Angle θ1 is an angle defined by a line segment and tip 5*t* that the line segment first encounters when the line segment rotates around origin O from the reference axis in the positive direction. Similarly, angle θ2 is an angle defined by a line segment and tip 5*t* that the line segment encounters next to angle θ1 when the line segment rotates around origin O from the reference axis in the positive direction. Further, angle θ3 is an angle defined by a line segment and tip 5*t* that the line segment encounters next to angle θ2 when the line segment rotates around origin O from the reference axis in the positive direction.

Angles θ1, θ2, and θ3 are generically referred to as angle θn (n=1, 2, 3).

With reference to FIG. 11B, angle (θc−Δθc) is an angle defined by a line segment and one tip 10*t* of notch 10*n* that the line segment first encounters when the line segment rotates around origin O from the reference axis of fixed magnetic body 10 in the positive direction. Similarly, angle (θc+Δθc) is an angle defined by a line segment and the other tip 10*t* of notch 10*n* that the line segment next encounters when the line segment rotates around origin O from the reference axis of fixed magnetic body 10 in the positive direction.

That is, angle θc is the angle defined by the center of notch 10*n* and the reference axis, and angle (2×Δθc) is the central angle of a circular segment defined by one tip 10*t* and the other tip 10*t* of notch 10*n* with origin O being a center.

In a more preferred example of embodiment 1, tips 5*t* of fixed electrode 5 preferably do not overlap with notch 10*n* of fixed magnetic body 10.

This is because such a configuration allows a stronger Lorentz force Fa to act on arc discharge a3 in the vicinity of tips 5*t* of fixed electrode 5, as compared with the case in which tips St of fixed electrode 5 overlap with notch 10*n* of fixed magnetic body 10.

In other words, tips 5*t* of fixed electrode 5 preferably overlap with the solid part of fixed magnetic body 10. Thus, in a more preferred example of embodiment 1, for each of angles θ1, θ2, and θ3, a condition of angle (θc−Δθc)>angle θn (n=1, 2, 3) or a condition of angle θn (n=1, 2, 3)>angle (θc+Δθc) be preferably satisfied.

For the same reason, tips 8*t* of moving electrode 8 preferably do not overlap with notch 11*n* of moving magnetic body 11. In other words, tips 8*t* of moving electrode 8 preferably overlap with the solid part of moving magnetic body 11.

With reference to FIG. 12, a variation of embodiment 1 will now be described.

Figure 12A:
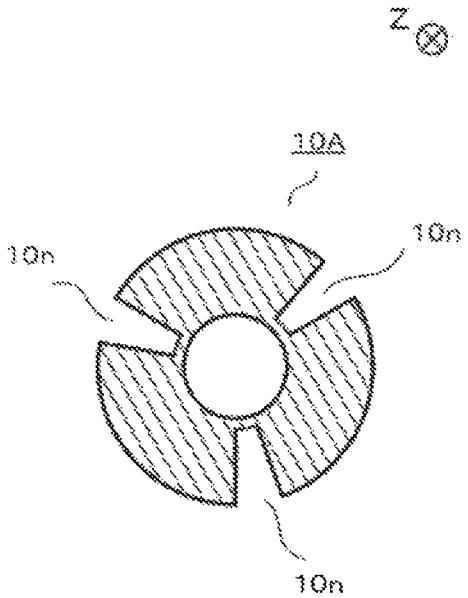
FIG. 12A shows a front view illustrating the shape of a fixed magnetic body 10A in a variation of embodiment 1.
Figure 12B:
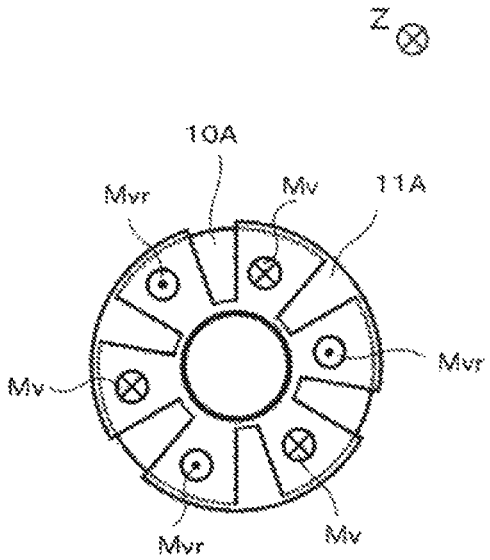
FIG. 12B show front views illustrating the shapes of a fixed magnetic body 10A and a moving magnetic body 11A and the densities of the magnetic fluxes generated in a variation of embodiment 1.

FIG. 12 show front views illustrating the shapes of a fixed magnetic body 10A and a moving magnetic body 11A and the magnetic fluxes generated in the variation of embodiment 1. FIG. 12A shows the front of fixed magnetic body 10A in the variation of embodiment 1. FIG. 12B shows the front of fixed magnetic body 10A and moving magnetic body 11A in place in the variation of embodiment 1.

With reference to FIG. 12A, fixed magnetic body 10A has three notches 10*n* equally spaced on the circumference. Similarly, moving magnetic body 11A also has three notches 11*n* equally spaced on the circumference.

With reference to FIG. 12B, moving magnetic body 11A is 60 degrees rotationally displaced from fixed magnetic body 10A around a Z-direction axis, so that notches 11*n* do not overlap with notches 10*n*.

When current Id flows, leakage fluxes Mv and Mvr are generated at three locations, with leakage fluxes Mv and Mvr alternating. That is, parallel magnetic fields are formed. Thus, at the time of interruption operation, if arc discharge a1 occurs through central portion 8*c* of moving electrode 8 and central portion 5*c* of fixed electrode 5, it can be extinguished.

Thus, according to a more preferred example and variation of embodiment 1 as described above, vacuum interrupter 100 can, in a closed state, reduce a repulsive force in the direction toward an open state between fixed electrode 5 and moving electrode 8. This can prevent upsizing and complication of the load application mechanism.

Further, at the time of interruption operation, vacuum interrupter 100 can quickly extinguish arc discharge a1 occurring between fixed electrode 5 and moving electrode 8.

That is, according to embodiment 1, a small-sized, reliable vacuum interrupter can be provided.

Embodiment 2

Embodiment 1 has described a mode in which contact surface 8*f* of moving electrode 8 is a flat surface.

Embodiment 2 describes a mode in which contact surface 8*f* of moving electrode 8 has a protrusion 8*x*.

Figure 13:
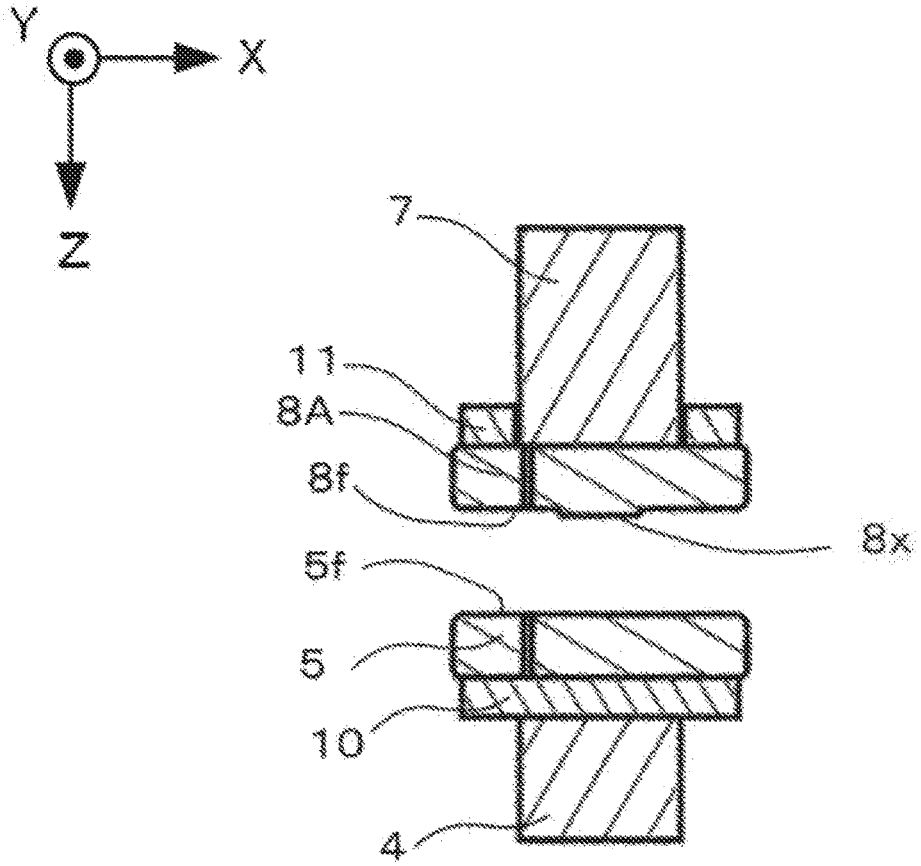
FIG. 13 is a cross-sectional view illustrating a part including fixed electrode 5, moving electrode 8A, and their surrounding area in embodiment 2 of the present invention.

FIG. 13 is a cross-sectional view illustrating a part including fixed electrode 5, a moving electrode 8A, and their surrounding area. The other regions are the same as those of vacuum interrupter 100 in embodiment 1.

In FIG. 13, the same reference numbers or signs as those of FIGS. 1 and 2 designate the same or equivalent elements as those described in embodiment 1, and thus the detailed description of such elements is omitted.

With reference to FIG. 13, contact surface 8*f* of moving electrode 8A has protrusion 8*x* at central portion 8*c*. If contact surface 8*f* is a flat surface as described above, it may be difficult to predict where on contact surface 8*f* an arc discharge will initially occur. However, the interruption ability has to be ensured for any behavior of arc discharge located at any position on contact surface 8*f*. This may lead to a complicated design of moving electrode 8A, fixed electrode 5, moving magnetic body 11, and fixed magnetic body 10.

By providing protrusion 8*x* at central portion 8*c* of contact surface 8*f* of moving electrode 8A, the position on contact surface 8*f* at which the electrodes remain in contact to the last moment at the time of interruption operation can be limited to protrusion 8*x*. That is, the position where an arc discharge initially occurs can be limited to protrusion 8*x*, thus simplifying the design of moving electrode 8A, fixed electrode 5, moving magnetic body 11, and fixed magnetic body 10. Further, when a current is carried between the fixed stem and the moving stem with the vacuum interrupter being in a closed state, a repulsive force to put the vacuum interrupter toward an open state can be reduced.

The mechanism of the generation of repulsive force has been mentioned above by taking a conventional vacuum interrupter as an example. As mentioned before, the repulsive force is caused by Lorentz forces Fu and Fd due to current components Icu and Icd flowing in the vacuum interrupter in a closed state. If the contact part is limited to protrusion 8*x* of central portion 8*c*, the current does not flow through the wings, resulting in reduction in repulsive force.

Further, when a current is carried between the fixed stem and the moving stem with the vacuum interrupter being in a closed state, the generation of Joule loss can be reduced. Fixed electrode 5 and moving electrode 8, which are made of an alloy mainly composed of a conductive material (e.g., copper or silver), have a lower conductivity than, for example, pure copper. In order to reduce the Joule loss, it is preferred that the current-carrying path through fixed electrode 5 and moving electrode 8 be made shortest. A conventional vacuum interrupter, in which a current flows along the wings, has a long current-carrying path. By contrast, in embodiment 2, in which the contact portion is limited to central portion 8*c*, a current does not flow through the wings, thus allowing a shorter current path length.

The above describes a mode in which protrusion 8*x* is located at central portion 8*c* of contact surface 8*f* of moving electrode 8A. Alternatively, however, the protrusion may be located on the fixed electrode, or may be located on both moving electrode 8A and the fixed electrode.

Further, while protrusion 8*x* is located at central portion 8*c* in the above-described mode, protrusion 8*x* may be located at any position other than central portions 8*c* and 5*c* that can limit the position of initial arc discharge occurrence to protrusion 8*x*.

Embodiment 2 can provide the same advantageous effects as those of vacuum interrupter 100 in embodiment 1. Additionally, embodiment 2 can simplify the design of moving electrode (8, 8A), fixed electrode 5, moving magnetic body 11, and fixed magnetic body 10, resulting in reduction in product cost. Also, a small-sized, reliable vacuum interrupter can be provided.

Further, embodiment 2 can provide a small-sized, reliable vacuum interrupter with a reduced magnitude of electromagnetic repulsive force, without upsizing and complication of the reduction load application mechanism. Still further, embodiment 2 can provide an efficient vacuum interrupter having a reduced Joule loss.

Embodiment 3

Embodiment 1 describes a mode in which notch 11*n* of moving magnetic body 11 is 180 degrees rotationally displaced from notch 10*n* of fixed magnetic body 10 around a Z-direction axis.

Embodiment 3 describes a mode in which notch 11*n* is rotationally displaced from notch 10*n* by an angle other than 180 degrees around the Z direction, so that the two regions where the solid part of moving magnetic body 11 overlaps with the solid part of fixed magnetic body 10 (i.e., regions v1 and v2 in embodiment 1) have different areas.

FIG. 14 shows a layout illustrating the areas of the parts where the solid part of moving magnetic body 11 overlaps with the solid part of fixed magnetic body 10, and shows a front view illustrating arc discharges on fixed electrode 5.

Figure 14A:
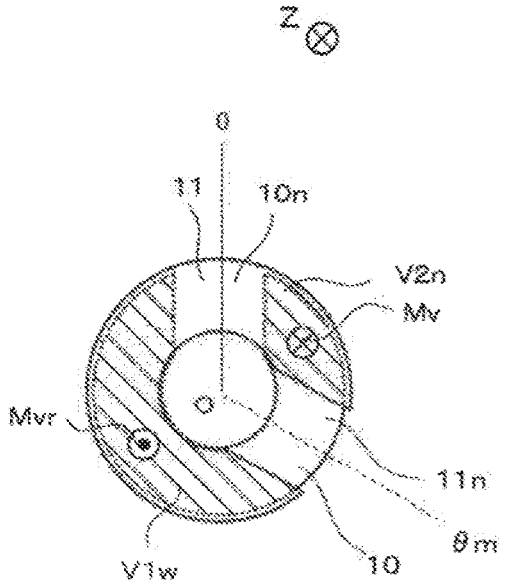
FIG. 14A shows a layout illustrating the areas of the parts where the solid part of moving magnetic body 11 overlaps with the solid part of fixed magnetic body 10 in embodiment 3 of the present invention.

FIG. 14A shows a layout of moving magnetic body 11 and fixed magnetic body 10 as seen from front in the Z direction, with the directions of leakage fluxes Mv, Mvr, and Mp added therein. Regions v1*w* and v2*n* are the region where the solid part of moving magnetic body 11 overlaps with the solid part of fixed magnetic body 10.

Figure 14B:
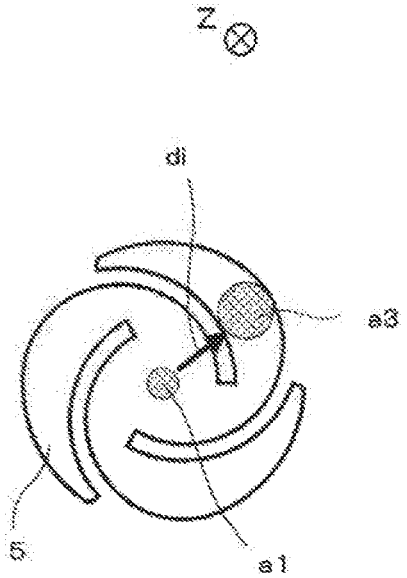
FIG. 14B shows a front view illustrating arc discharges on fixed electrode 5 in embodiment 3 of the present invention.

FIG. 14B is a front view illustrating the state of arc discharges (a1, a3) on contact surface 5*f* of fixed electrode 5.

In FIG. 14, the same reference numbers or signs as those of FIGS. 1 to 13 designate the same or equivalent elements as those described in embodiments 1 and 2, and thus the detailed description of such elements is omitted.

With reference to FIG. 14A, notch 11*n* of moving magnetic body 11 is displaced from notch 10*n* of fixed magnetic body 10 around the Z direction by an angle θm other than 180 degrees.

Accordingly, region v1*w* and region v2*n* are not equal in area. Here, region v2*n* has a smaller area than region v1*w*.

Leakage flux Mv mainly passes through region v2*n*, whereas leakage flux Mvr mainly passes through region v1*w*. By the nature of magnetic field, leakage fluxes Mv and Mvr equally contribute to the parallel magnetic field intensity. Accordingly, region v2*n* has a higher magnetic flux density than region v1*w*.

With reference to FIG. 14B, an arc discharge typically has the property of moving to a place having a higher intensity of magnetic field parallel to the discharge current (parallel magnetic field), as described above. Accordingly, arc discharge a1 from central portion 8*c* to central portion 5*c* moves in the direction di to region v2*n* (to the position of arc discharge a3).

Then, with Lorentz force Fa, arc discharge a3 circulates on contact surface 8*f* of moving electrode 8 and on contact surface 5*f* of fixed electrode 5, thereby being cooled and extinguished, as in embodiment 1.

That is, an initial arc discharge can be guided to move in direction di. This allows a simplified design of the moving electrode, the fixed electrode, the fixed magnetic body, and the moving magnetic body, as in embodiment 2.

Embodiment 3 can provide the same advantageous effects as those of vacuum interrupter 100 in embodiment 1. Additionally, embodiment 3 can simplify the design of the moving electrode, the fixed electrode, the fixed magnetic body, and the moving magnetic body, resulting in reduction in product cost. Also, a small-sized, reliable vacuum interrupter can be provided.

Embodiment 4

Embodiment 4 describes a mode in which a gap 13 is provided between moving electrode 8 and moving magnetic body 11, and by fixed electrode 5 and fixed magnetic body 10.

Figure 15:
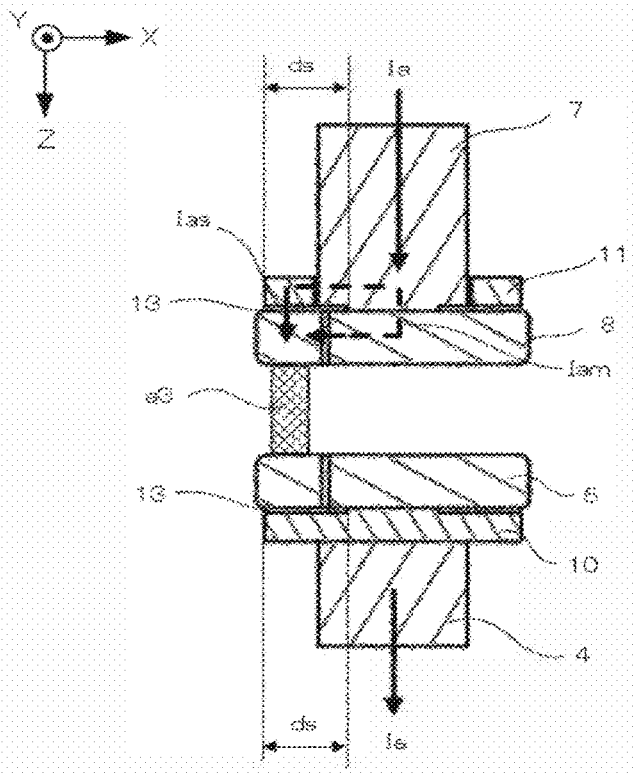
FIG. 15 is a cross-sectional view illustrating a part including fixed electrode 5, moving electrode 8, and their surrounding area of a vacuum interrupter in embodiment 4 of the present invention.

FIG. 15 is a cross-sectional view illustrating a part including fixed electrode 5, moving electrode 8, and their surrounding area of a vacuum interrupter.

In FIG. 15, the same reference numbers or signs as those of FIGS. 1 to 13 designate the same or equivalent elements as those described in embodiments 1 and 2, and thus the detailed description of such elements is omitted.

With reference to FIG. 15, gap 13 is provided between moving electrode 8 and moving magnetic body 11, and by fixed electrode 5 and fixed magnetic body 10.

Embodiment 1 describes a mode with no gap 13, where an arc discharge occurring at the time of interruption operation causes current Ia to flow through wings 8*w* of moving electrode 8 in the Y direction and through wings 5*w* of fixed electrode 5 in the direction opposite to the Y direction.

Specifically, with no gap 13, current Ia branches into a current component Iam flowing from moving current-carrying stem 7 to wings 8*w*, and a current component Ias flowing from moving current-carrying stem 7 to wings 8*w* via moving magnetic body 11.

Current component Iam contributes to Lorentz force Fa that drives an arc discharge, whereas current component Ias does not contribute to Lorentz force Fa.

Gap 13 can decrease current component Ias and increase current component Iam, thus strengthening Lorentz force Fa. That is, Lorentz force Fa can improve the effectiveness of driving an arc discharge to extinguish it.

Embodiment 4 can provide the same advantageous effects as those of vacuum interrupter 100 in embodiment 1. Additionally, embodiment 4 can provide a small-sized, reliable vacuum interrupter that can improve the effectiveness of driving an arc discharge to extinguish it.

Next, examples according to embodiment 4 are shown. The examples have different widths ds of gap 13 (see FIG. 15), and their effects are compared.

Comparison Examples

Figure 16:
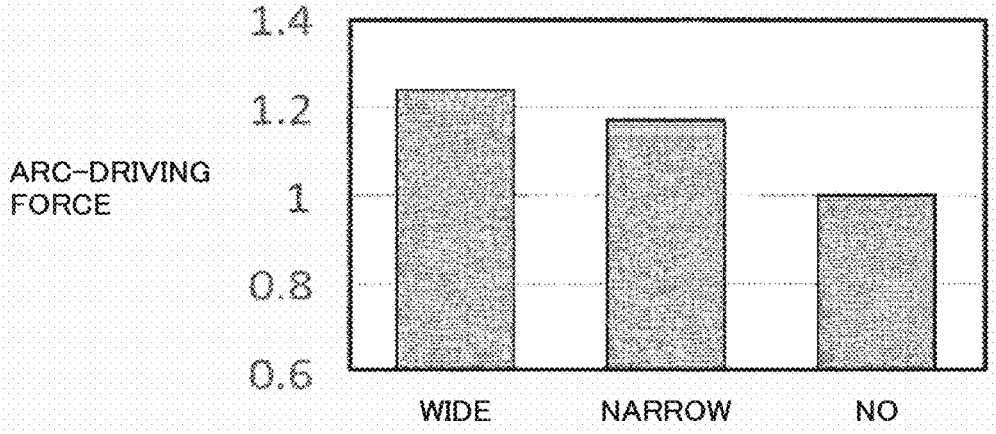
FIG. 16 is a graph comparing the arc-driving forces with different widths ds.
Figure 17A:
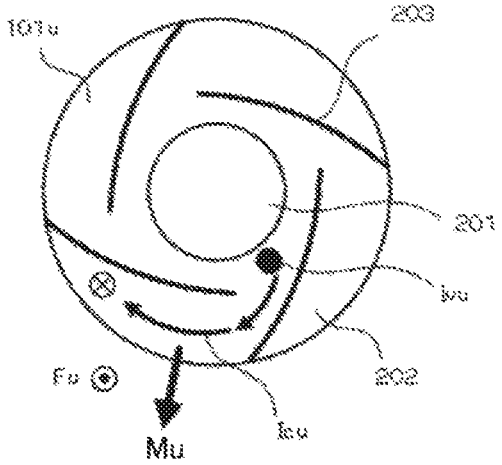
FIG.17A PRIOR ART
FIG. 17A shows a front view illustrating Lorentz forces acting in a conventional vacuum interrupter.
Figure 17B:
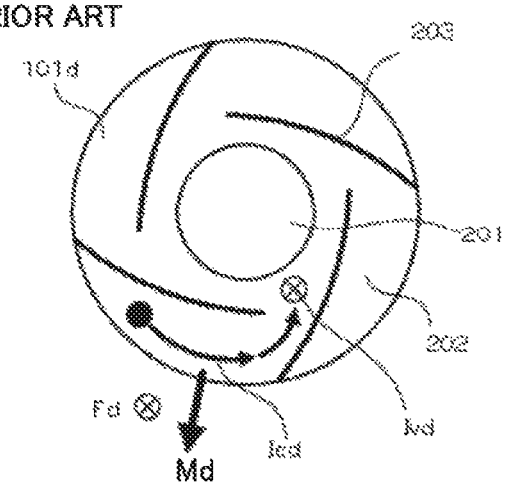
FIG.17B PRIOR ART
FIG. 17B shows a front view illustrating Lorentz forces acting in a conventional vacuum interrupter.

FIG. 16 is a graph comparing the arc-driving forces among three types of vacuum interrupters: with no gap 13, "no"; with gap 13 having a relatively narrow width ds, "narrow"; and with gap 13 having a relatively wide width ds, "wide". The arc-driving force is a value obtained by calculating a Lorentz force on an arc discharge by electromagnetic field calculation. The vertical axis shows the relative value of arc-driving force.

FIG. 16 shows that gap 13 having a wider width ds produces a stronger arc-driving force. This results in an efficient decrease in current component Ias and increase in current component Iam, thus strengthening Lorentz force Fa.

Embodiment 5

Embodiment 5 describes a vacuum interrupter 110 in which a moving magnetic body 11B has inclined portions 11*s* in the vicinity of notch 11*n*, and a fixed magnetic body 10B has inclined portions 10*s* in the vicinity of notch 10*n*.

Further, as a variation of embodiment 5, a vacuum interrupter 120 is also described in which a moving magnetic body 11C has step portions 11*e* in the vicinity of notch 11*n*, and a fixed magnetic body 10C has step portions 10*e* in the vicinity of notch 10*n*.

These structures can improve the intensities of leakage fluxes Mv and Mvr and quickly extinguish an arc discharge.

With reference to FIGS. 18 to 23, description will now be given to the differences of vacuum interrupter 110 in embodiment 5 from vacuum interrupter 100 in embodiment 1, and to the features of vacuum interrupter 110.

Figure 18:
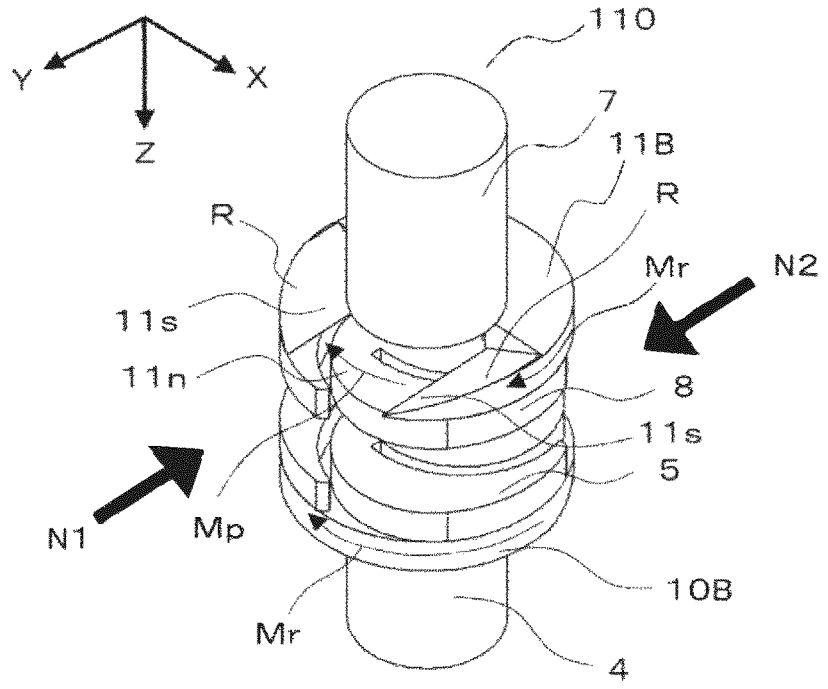
FIG. 18 is a perspective view illustrating a part including a moving magnetic body 11B, a fixed magnetic body 10B, and their surrounding area of a vacuum interrupter 110 in embodiment 5.

FIG. 18 is a perspective view illustrating a part including moving magnetic body 11B, fixed magnetic body 10B, and their surrounding area of vacuum interrupter 110 in embodiment 5, with the directions of magnetic flux Mr and leakage fluxes Mv, Mvr, and Mp added therein.

Figure 19:
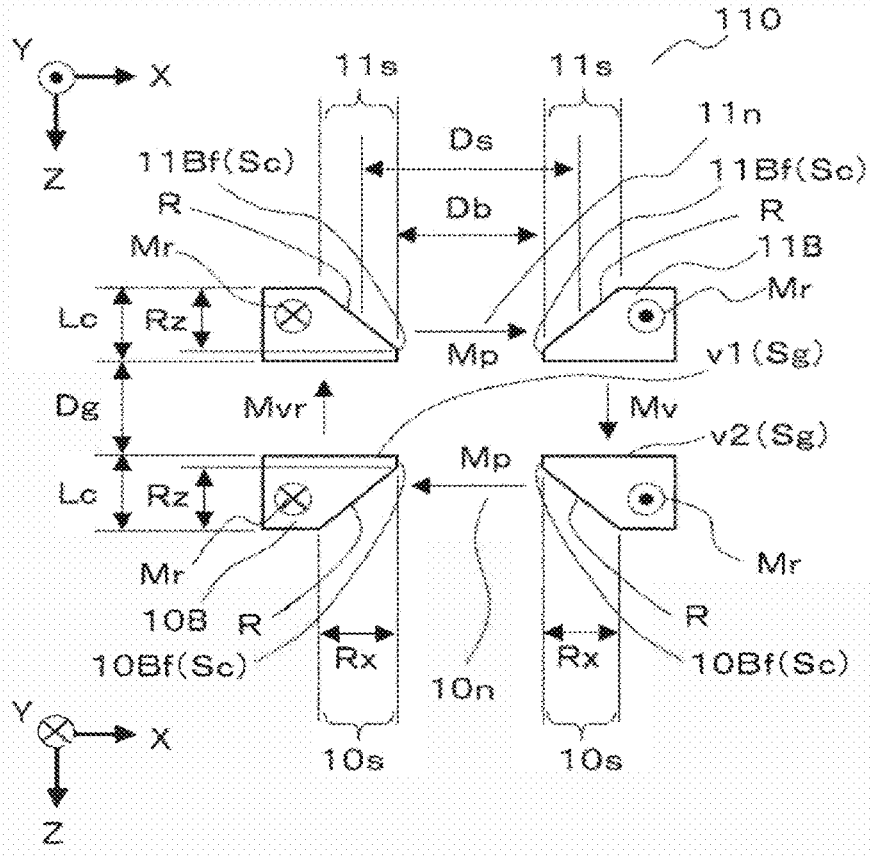
FIG. 19 is a side view illustrating moving magnetic body 11B and fixed magnetic body 10B of vacuum interrupter 110 in embodiment 5.

FIG. 19 is a side view illustrating, on the upper half of the drawing sheet, a lateral side of moving magnetic body 11B as seen from direction N1 in FIG. 18; and illustrating, on the lower half of the drawing sheet, a lateral side of fixed magnetic body 10B as seen from direction N2 in FIG. 18, with the directions of magnetic flux Mr and leakage fluxes Mv, Mvr, and Mp added therein. Moving electrode 8 and fixed electrode 5 are not shown. Direction N1 coincides with the direction opposite to the Y direction, and direction N2 coincides with the Y direction.

Figure 20:
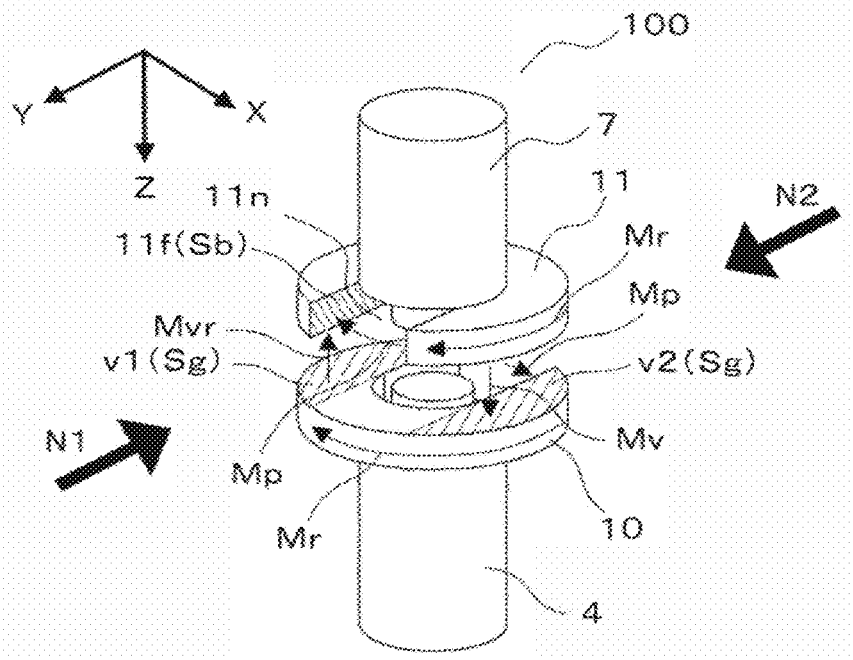
FIG. 20 is a perspective view illustrating a part including moving magnetic body 11, fixed magnetic body 10, and their surrounding area of vacuum interrupter 100 in embodiment 1.

FIG. 20 is a perspective view illustrating a part including moving magnetic body 11, fixed magnetic body 10, and their surrounding area of vacuum interrupter 100 in embodiment 1, with the directions of magnetic flux Mr and leakage fluxes Mv, Mvr, and Mp added therein. Moving electrode 8 and fixed electrode 5 are not shown.

Figure 21:
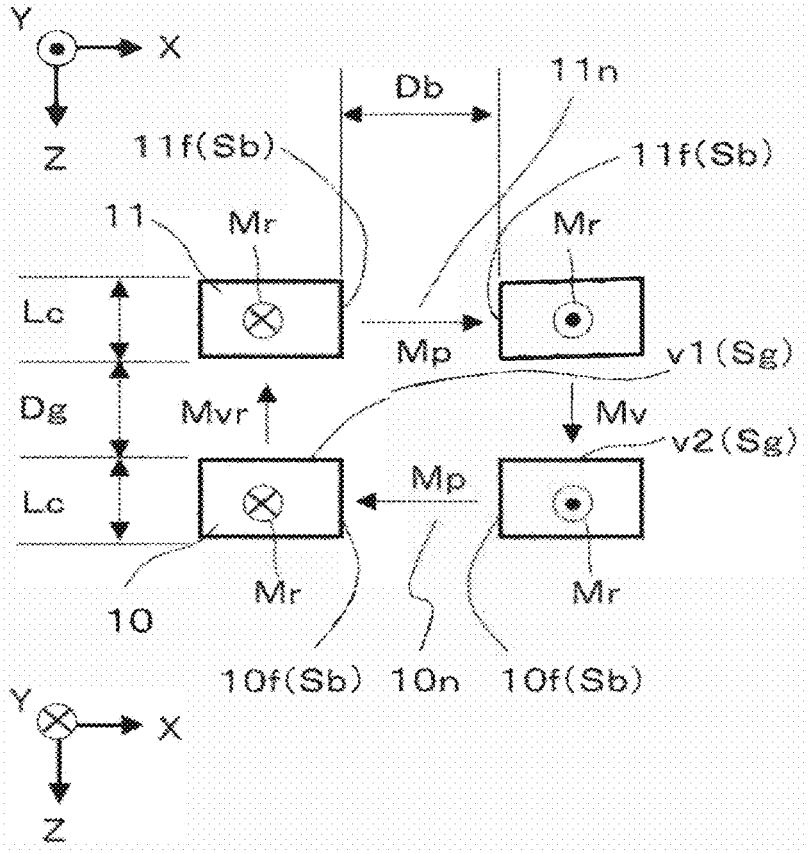
FIG. 21 is a side view illustrating moving magnetic body 11 and fixed magnetic body 10 of vacuum interrupter 100.

FIG. 21 is a side view illustrating, on the upper half of the drawing sheet, a lateral side of moving magnetic body 11 as seen from direction N1 in FIG. 20; and illustrating, on the lower half of the drawing sheet, a lateral side of fixed magnetic body 10 as seen from direction N2 in FIG. 20, with the directions of magnetic flux Mr and leakage fluxes Mv, Mvr, and Mp added therein. Moving electrode 8 and fixed electrode 5 are not shown. Direction N1 coincides with the direction opposite to the Y direction, and direction N2 coincides with the Y direction.

Figure 22:
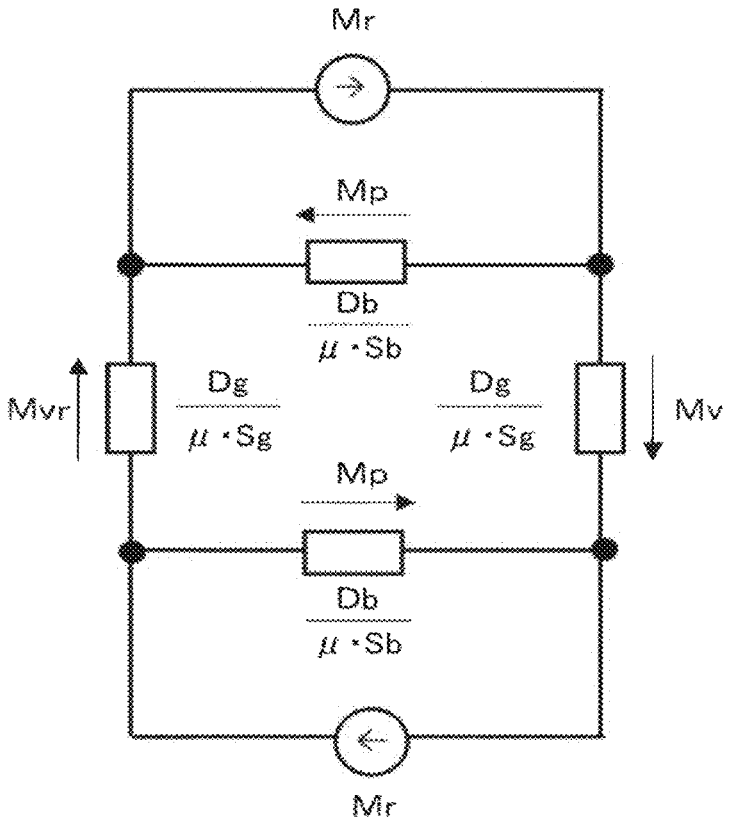
FIG. 22 is a magnetic circuit diagram illustrating a magnetic circuit of vacuum interrupter 100.
Figure 23:
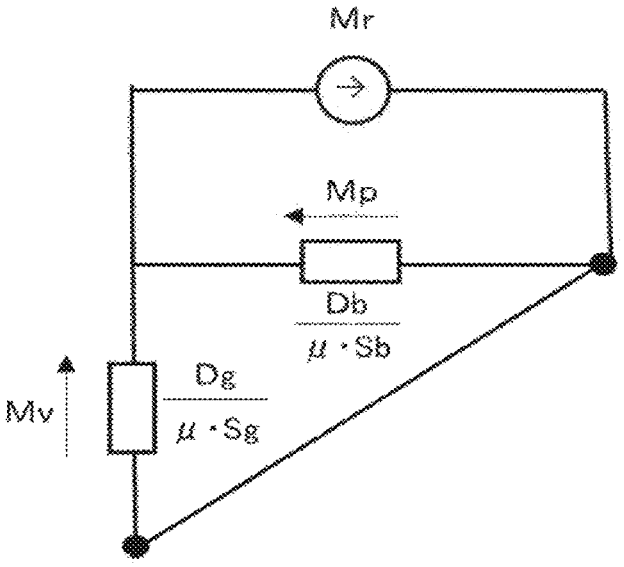
FIG. 23 is a magnetic circuit diagram simplifying the circuit diagram of FIG. 22.

Further, FIG. 22 is a magnetic circuit diagram illustrating a magnetic circuit of vacuum interrupter 100, and FIG. 23 is a magnetic circuit diagram simplifying the circuit diagram of FIG. 22.

In FIGS. 18 to 23, the same reference numbers or signs as those of FIGS. 1 to 12 designate the same or equivalent elements as those described in embodiment 1, and thus the detailed description of such elements is omitted.

Also, vacuum interrupter 110 in embodiment 5 is similar to vacuum interrupter 100 in embodiment 1 in the regions other than moving magnetic body 11B and fixed magnetic body 10B, and thus the detailed description of the general configuration of vacuum interrupter 110 is also omitted.

Region v1 and region v2 have the same area, denoted by area Sg; and moving magnetic body 11 and fixed magnetic body 10 have the same thickness in the Z direction, denoted by thickness Lc. An end face 11*f* of moving magnetic body 11 adjoining notch 11*n* and an end face 10*f* of fixed magnetic body 10 adjoining notch 10*n* have the same area, denoted by area Sb.

First, with reference to FIGS. 20 to 23, description will now be given to the shapes of moving magnetic body 11 and fixed magnetic body 10 of vacuum interrupter 100 and the magnetic fluxes generated in embodiment 1, and further given to a magnetic circuit formed by vacuum interrupter 100.

Notches 11*n* and 10*n*, which have a low magnetic permeance, cause magnetic flux Mr to branch into leakage flux Mp and leakage flux Mv. That is, the relation of (the total quantity of magnetic flux Mr)=(the total quantity of leakage flux Mp)+(the total quantity of leakage flux Mv) is satisfied. Similarly, magnetic flux Mr branches into leakage flux Mp and leakage flux Mvr, and thus the relation of (the total quantity of magnetic flux Mr)=(the total quantity of leakage flux Mp)+(the total quantity of leakage flux Mvr) is satisfied.

Further, with reference to FIG. 22, description will now be given to a magnetic circuit related to magnetic flux Mr and leakage fluxes Mv, Mvr, and Mp.

As to moving magnetic body 11, the magnetic reluctance of notch 11*n* through which leakage flux Mp transmits is Db/(μ·Sb), where Sb denotes the area of end face 11*f* of moving magnetic body 11, Db denotes the distance between the edges of end face 11*f*, and μ denotes the magnetic permeability.

Similarly, as to fixed magnetic body 10, the magnetic reluctance of notch 10*n* through which leakage flux Mp transmits is Db/(μ·Sb), where Sb denotes the area of end face 10*f* of fixed magnetic body 10, and Db denotes the distance between the edges of end face 10*f*.

The magnetic reluctance between moving magnetic body 11 and fixed magnetic body 10 through which leakage flux Mv transmits is Dg/(μ·Sg), where Sg denotes the area of region v2, and Dg denotes the distance between moving magnetic body 11 and fixed magnetic body 10.

Similarly, the magnetic reluctance between moving magnetic body 11 and fixed magnetic body 10 through which leakage flux Mvr transmits is Dg/(μ·Sg), where Sg denotes the area of region v1, and Dg denotes the distance between moving magnetic body 11 and fixed magnetic body 10.

Leakage fluxes Mv and Mvr are opposite in direction but equal in absolute value. Accordingly, the magnetic circuit shown in FIG. 22 can be replaced by a simplified magnetic circuit shown in FIG. 23 because of the symmetry. Further, formula 1 below can be derived from the magnetic circuit of FIG. 23.

$$Mv = Mr \times \frac{\frac{Db}{\mu \cdot Sb}}{\frac{Dg}{\mu \cdot Sg} + \frac{Db}{\mu \cdot Sb}} = Mr \times \frac{1}{1 + \frac{Dg}{Db} \times \frac{Sb}{Sg}} \quad \text{[Formula 1]}$$

Formula 1 shows that leakage fluxes Mv and Mvr can be increased by increasing distance Db between the edges and by decreasing area Sb.

Next, with reference to FIGS. 18 and 19, vacuum interrupter 110 in embodiment 5 will now be described.

Vacuum interrupter 100 in embodiment 1 described above has moving magnetic body 11 and fixed magnetic body 10. However, vacuum interrupter 110 has moving magnetic body 11B, instead of moving magnetic body 11, and fixed magnetic body 10B, instead of fixed magnetic body 10.

Moving magnetic body 11B includes inclined portions 11*s* at its both ends adjoining notch 11*n*, each inclined portion 11*s* having an inclined surface R. Similarly, fixed magnetic body 10B includes inclined portions 10*s* at its both ends adjoining notch 10*n*, each inclined portion 10*s* having inclined surface R. Moving magnetic body 11B and fixed magnetic body 10B have the same shape. Specifically, inclined portions 11*s* and inclined portions 10*s* have the same shape.

Regions v1 and v2 each have area Sg, the same as that of vacuum interrupter 100; and moving magnetic body 11B and fixed magnetic body 10B each have thickness Lc in the Z direction, the same as that of vacuum interrupter 100.

Further, the area of an end face 11Bf of moving magnetic body 11B adjoining notch 11*n*, and the area of an end face 10Bf of fixed magnetic body 10B adjoining notch 10*n* are each denoted by area Sc.

The advantageous effects of inclined portions 11*s* and 10*s* will now be described.

As to moving magnetic body 11B, its end face 11Bf adjoining notch 11*n* has area Sc satisfying area Sc<area Sb. This is because, due to moving magnetic body 11B having inclined surfaces R, the length component of end face 11Bf in the Z direction satisfies (Lc−Rz), where Rz denotes the length component of inclined surfaces R in the Z direction.

The distance between one end face 11Bf and the other end face 11Bf is set to Db. Further, average distance Ds between the inclined portions, i.e., the average distance between one inclined portion 11*s* and the other inclined portion 11*s*, satisfies Ds=((Rx·Rz)/Lc+Db), where Rx denotes the length component of inclined surfaces R in the X direction, and Rz denotes the length component of inclined surfaces R in the Z direction. Since Rx>0 and Rz>0 are satisfied, Ds>Db is always satisfied. In other words, inclined portions 11*s* of moving magnetic body 11B allow the effective distance between the inclined portions to be longer than Db.

In view of formula 1, providing inclined portions 11*s* and 10*s* and setting average distance Ds between the inclined portions and area Sc is equivalent to increasing distance Db between the edges and decreasing area Sb as described above. Thus, the intensities of leakage fluxes Mv and Mvr can be strengthened.

The description of moving magnetic body 11B also applies to fixed magnetic body 10B, which has the same shape as moving magnetic body 11B. Thus, fixed magnetic body 10B can also strengthen the intensities of leakage fluxes Mv and Mvr.

Providing inclined portions 11*s* and 10*s* can thus strengthen the parallel magnetic field intensity. This allows an arc discharge to move to region v1 or v2, thereby improving the effectiveness of extinguishing the arc discharge.

Figure 24:
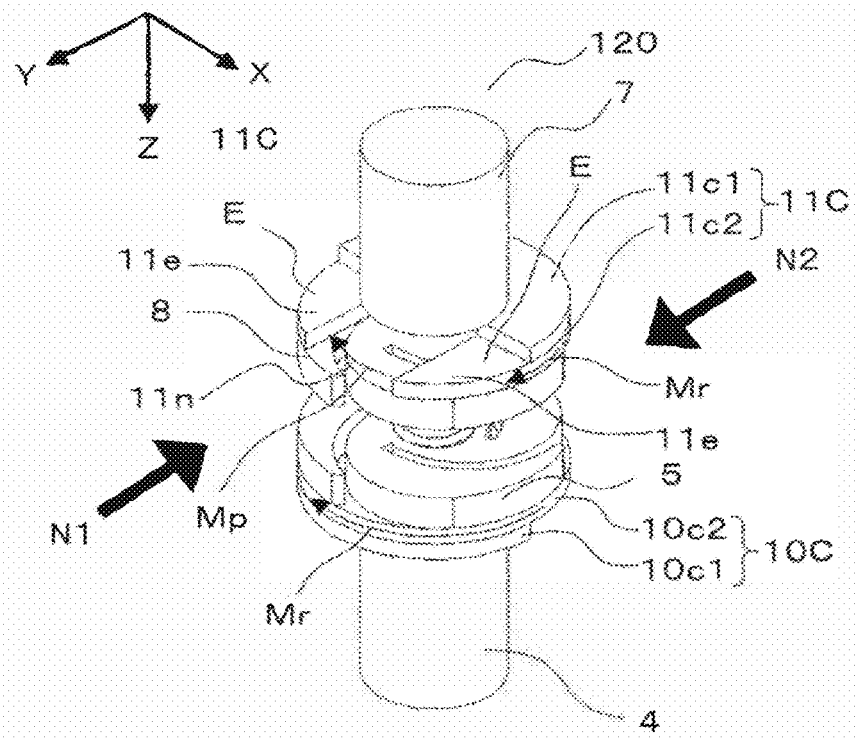
FIG. 24 is a perspective view illustrating a part including a moving magnetic body 11C, a fixed magnetic body 10C, and their surrounding area of a vacuum interrupter 120 in a variation of embodiment 5.
Figure 25:
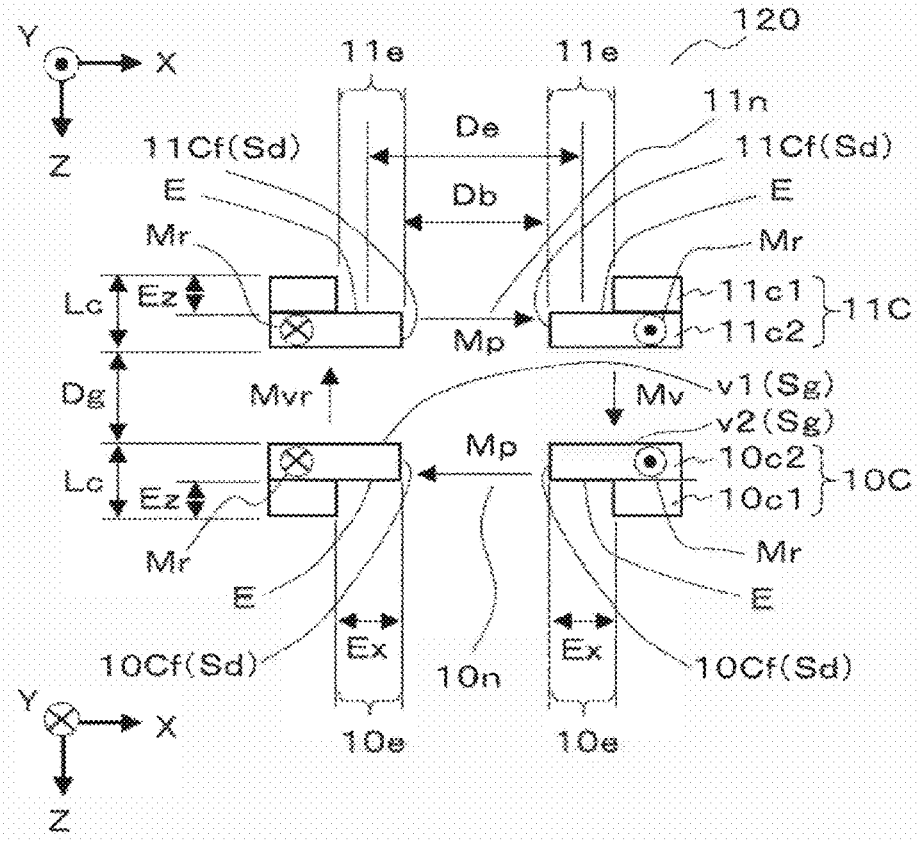
FIG. 25 is a side view illustrating moving magnetic body 11C and fixed magnetic body 10C of vacuum interrupter 120 in the variation of embodiment 5.

With reference to FIGS. 24 and 25, the features of vacuum interrupter 120 in a variation of embodiment 5 will now be described.

FIG. 24 is a perspective view illustrating a part including moving magnetic body 11C, fixed magnetic body 10C, and their surrounding area of vacuum interrupter 120 in the variation of embodiment 5, with the directions of magnetic flux Mr and leakage fluxes Mv, Mvr, and Mp added therein.

FIG. 25 is a side view illustrating, on the upper half of the drawing sheet, a lateral side of moving magnetic body 11C as seen from direction N1 in FIG. 24; and illustrating, on the lower half of the drawing sheet, a lateral side of fixed magnetic body 10C as seen from direction N2 in FIG. 24, with the directions of magnetic flux Mr and leakage fluxes Mv, Mvr, and Mp added therein. Moving electrode 8 and fixed electrode 5 are not shown. Direction N1 coincides with the direction opposite to the Y direction, and direction N2 coincides with the Y direction.

In FIGS. 24 and 25, the same reference numbers or signs as those of FIGS. 1 to 12 and 18 to 23 designate the same or equivalent elements as those described in embodiment 1, and thus the detailed description of such elements is omitted.

Also, vacuum interrupter 120 is similar to vacuum interrupter 100 in embodiment 1 in the regions other than moving magnetic body 11C and fixed magnetic body 10C, and thus the detailed description of the general configuration of vacuum interrupter 120 is also omitted.

Vacuum interrupter 100 in embodiment 1 described above has moving magnetic body 11 and fixed magnetic body 10. However, vacuum interrupter 120 has moving magnetic body 11C, instead of moving magnetic body 11, and fixed magnetic body 10C, instead of fixed magnetic body 10.

Moving magnetic body 11C includes step portions 11*e* at its both ends adjoining notch 11*n*, each step portion 11*e* having a stepped surface E. Similarly, fixed magnetic body 10C includes step portions 10*e* at its both ends adjoining notch 10*n*, each step portion 10*e* having stepped surface E. Moving magnetic body 11C and fixed magnetic body 10C have the same shape. Specifically, step portions 11*e* and step portions 10*e* have the same shape.

Moving magnetic body 11C includes plate magnetic members 11*c*1 and 11*c*2 one on top of the other. Similarly, fixed magnetic body 10C includes plate magnetic members 10*c*1 and 10*c*2 one on top of the other. Magnetic members 11*c*1 and 10*c*1 have the same shape, and their thickness in the Z direction is a length component Ez.

Magnetic members 11*c*2 and 10*c*2 have the same shape, and their thickness in the Z direction is a thickness (Lc−Ez).

Plate magnetic members 11*c*1 and 10*c*1 are an example of the first plate magnetic body in the claims, and plate magnetic members 11*c*2 and 10*c*2 are an example of the second plate magnetic body in the claims.

Regions v1 and v2 each have area Sg, the same as that of vacuum interrupter 100; and moving magnetic body 11B and fixed magnetic body 10B each have thickness Lc in the Z direction, the same as that of vacuum interrupter 100.

Further, the area of an end face 11Cf of moving magnetic body 11C adjoining notch 11*n*, and the area of an end face 10Cf of fixed magnetic body 10C adjoining notch 10*n* are each denoted by area Sd.

The advantageous effects of step portions 11*e* and 10*e* will now be described.

As to moving magnetic body 11C, its end face 11Cf adjoining notch 11*n* has area Sd satisfying area Sd<area Sb. This is because, due to moving magnetic body 11C having stepped surfaces E, length component Rz of stepped surfaces E in the Z direction satisfies Rz=(Lc−Ez)<Lc.

The distance between one end face 11Cf and the other end face 11Cf is set to Db. Further, average distance De between the step portions, i.e., the average distance between one step portion 11*e* and the other step portion 11*e*, satisfies De=((2·Ex·Ez)/Lc+Db), where Ex denotes the length component of stepped surfaces E in the X direction, and Ez denotes the length component of stepped surfaces E in the Z direction. Since Ex>0 and Ez>0 are satisfied, De>Db is always satisfied. In other words, step portions 11*e* of moving magnetic body 11C allow the effective distance between the step portions to be longer than Db.

In view of formula 1, providing step portions 11*e* and 10*e* and setting average distance De between the step portions and area Sd is equivalent to increasing distance Db between the edges and decreasing area Sb as described above. Thus, the intensities of leakage fluxes Mv and Mvr can be strengthened.

The description of moving magnetic body 11C also applies to fixed magnetic body 10C, which has the same shape as moving magnetic body 11C. Thus, fixed magnetic body 10C can also strengthen the intensities of leakage fluxes Mv and Mvr.

Providing step portions 11*e* and 10*e* can thus strengthen the parallel magnetic field intensity. This allows an arc discharge to move to region v1 or v2, thereby improving the effectiveness of extinguishing the arc discharge.

In the above description, two plate magnetic members, 11*c*1 and 11*c*2, are placed one on top of the other to form stepped surfaces E of the step of step portions 11*e*. However, three or more plate magnetic members may be placed one on top of another to form a plurality of stepped surfaces. Similarly, as to step portions 10*e*, a plurality of stepped surfaces may be formed.

Embodiment 5 can provide the same advantageous effects as those of vacuum interrupter 100 in embodiment 1. Additionally, embodiment 5 can strengthen the parallel magnetic field intensity, thereby improving the effectiveness of extinguishing an arc discharge. In other words, a small-sized, reliable vacuum interrupter can be provided that can improve the effectiveness of extinguishing an arc discharge.

Embodiment 6

Embodiment 6 describes a vacuum interrupter 130 in which a moving magnetic body 11D has a magnetic deterioration portion 11*r*, instead of notch 11*n*, and a fixed magnetic body 10D has a magnetic deterioration portion 10*r*, instead of notch 10*n*.

Such a structure can improve the effectiveness of protecting parts from the metal vapor and metal particles scattering from moving electrode 8 and fixed electrode 5 due to the heat from arc discharge.

Figure 26:
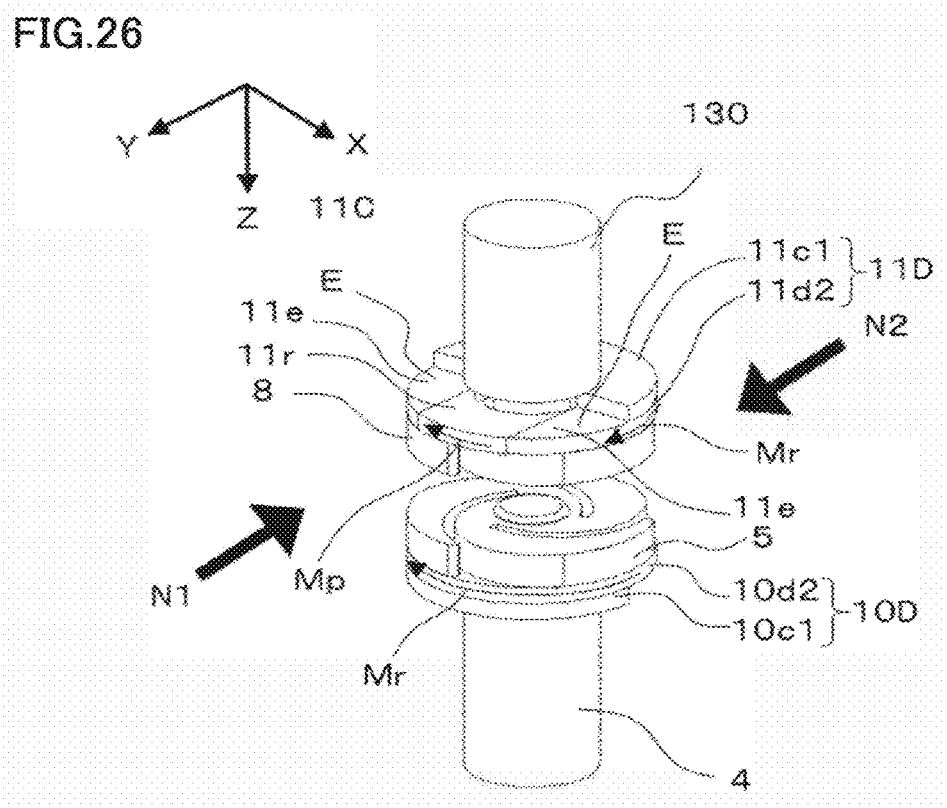
FIG. 26 is a perspective view illustrating a part including a moving magnetic body 11D, a fixed magnetic body 10D, and their surrounding area of a vacuum interrupter 130 in embodiment 6.

FIG. 26 is a perspective view illustrating a part including moving magnetic body 11D, fixed magnetic body 10D, and their surrounding area of vacuum interrupter 130 in embodiment 6, with the directions of magnetic flux Mr and leakage fluxes Mv, Mvr, and Mp added therein.

In FIG. 26, the same reference numbers or signs as those of FIG. 24 designate the same or equivalent elements as those described in the variation of embodiment 5, and thus the detailed description of such elements is omitted.

Also, vacuum interrupter 130 in embodiment 6 is similar to vacuum interrupter 120 in the variation of embodiment 5 in the regions other than moving magnetic body 11D and fixed magnetic body 10D, and thus the detailed description of the general configuration of vacuum interrupter 130 is also omitted.

The lateral side of vacuum interrupter 130 is similar to FIG. 25 except that notch 11*n* is replaced with magnetic deterioration portion 11*r* and that notch 10*n* is replaced with magnetic deterioration portion 10*r*. Thus, the lateral side of vacuum interrupter 130 is not shown here. Further, the directions of magnetic flux Mr and leakage fluxes Mv, Mvr, and Mp are the same as those of FIG. 25, and thus they are not shown here.

With reference to FIG. 26, the structure of moving magnetic body 11D and fixed magnetic body 10D will now be described.

Moving magnetic body 11D includes plate magnetic members 11*c*1 and 11*d*2 one on top of the other. Magnetic member 11*c*1 is similar to that of the variation of embodiment 5. Magnetic member 11*d*2 has magnetic deterioration portion 11*r*, instead of notch 11*n*.

Magnetic deterioration portion 11*r* is formed by magnetically deteriorating a part of magnetic member 11*d*2 by, for example, applying a pressure. In other words, magnetic deterioration portion 11*r* has a lower magnetic permeance than the other part of magnetic member 11*d*2.

Similarly, fixed magnetic body 10D includes plate magnetic members 10*c*1 and 10*d*2 one on top of the other. Magnetic member 10*c*1 is similar to that of the variation of embodiment 5. Magnetic member 10*d*2 has magnetic deterioration portion 10*r* (not shown), instead of notch 10*n*.

Magnetic deterioration portion 10*r* is formed by magnetically deteriorating a part of magnetic member 10*d*2 by, for example, applying a pressure. In other words, magnetic deterioration portion 10*r* has a lower magnetic permeance than the other part of magnetic member 10*d*2.

Magnetic deterioration portions 10*r* and 11*r* are an example of the first magnetic deterioration portion in the claims, and plate magnetic members 11*d*2 and 10*d*2 are an example of the second plate magnetic body in the claims.

The magnetic permeance of magnetic deterioration portions 11*r* and 10*r* is set to equal to the magnetic permeance of notches 11*n* and 10*n*. Thus, the magnetic flux flowing through magnetic deterioration portions 11*r* and 10*r* is equal to the total quantity of leakage flux Mp. Accordingly, vacuum interrupter 130 in embodiment 6 can strengthen the parallel magnetic field intensity, thereby improving the effectiveness of extinguishing an arc discharge, as with vacuum interrupter 120 in embodiment 5.

As mentioned above, the heat from arc discharge causes metal vapor and metal particles to scatter from moving electrode 8 and fixed electrode 5. With a vacuum interrupter (100, 110, 120) having an open notch (10*n*, 11*n*), the metal vapor and metal particles might scatter through the notch (10*n*, 11*n*).

By contrast, vacuum interrupter 130 in embodiment 6 has a non-open magnetic deterioration portion (10*r*, 11*r*) through which the metal vapor and metal particles cannot scatter, instead of the open notch (10*n*, 11*n*). That is, the magnetic deterioration portion (10*r*, 11*r*) can prevent the metal vapor and metal particles from scattering.

Embodiment 6 can provide the same advantageous effects as those of vacuum interrupter 120 in embodiment 5. Additionally, embodiment 6 has the effect of preventing scattering of metal vapor and metal particles caused by the heat from arc discharge. In other words, a small-sized, reliable vacuum interrupter can be provided that can improve the effectiveness of extinguishing an arc discharge.

In embodiments 1 to 5, the magnetic body (10, 10A, 10B, 10C, 11, 11A, 11B, 11C) strengthens the parallel magnetic field intensity by including the notch (10*n*, 11*n*) having a lower magnetic permeance than the solid part. Similarly, in embodiment 6, the magnetic body (10D, 11D) strengthens the parallel magnetic field intensity by including the magnetic deterioration portion (10*r*, 11*r*) having a lower magnetic permeance which is formed by deteriorating a part of the magnetic body (10D, 11D).

That is, it is simply required that the magnetic body (10, 10A, 10B, 10C, 10D, 11, 11A, 11B, 11C, 11D) include a lower magnetic permeance portion, which is a portion having a lower magnetic permeance. The lower magnetic permeance portion may be a groove formed in a part of the magnetic body, instead of the notch (10*n*, 11*n*) or magnetic deterioration portion (10*r*, 11*r*).

For example, the groove may be formed by cutting the magnetic body in the thickness direction from its surface to an appropriate depth by machining.

In embodiments 5 and 6, the magnetic body (10B, 10C, 10D, 11B, 11C, 11D) include the inclined portions (10*s*, 11*s*) or step portions (10*e*, 11*e*) disposed at its both ends adjoining the notch (10*n*, 11*n*) or magnetic deterioration portion (10*r*, 11*r*). The inclined portions (10*s*, 11*s*) or step portions (10*e*, 11*e*) have a reduced magnetic permeance as compared to the other portion except the notch (10*n*, 11*n*), thus strengthening the parallel magnetic field intensity.

That is, it is simply required that the magnetic body (10B, 10C, 11B, 11C) include a magnetic permeance reduction portion at its both ends adjoining the notch (10*n*, 11*n*), the magnetic permeance reduction portion having a reduced magnetic permeance. The magnetic permeance reduction portion may be a second magnetic deterioration portion having a lower degree of magnetic deterioration than the first magnetic deterioration portion.

In the above description, step portions 11*e* include magnetic members 11*c*1 and 11*c*2 one on top of the other. However, step portions 11*e* may be made of a single magnetic member. Specifically, the magnetic permeance reduction portion may be formed by machining.

In the above description, the magnetic permeance reduction portion is disposed at both ends of the lower magnetic permeance portion. However, the magnetic permeance reduction portion may be disposed at only one end of the lower magnetic permeance portion, in which case the effect of strengthening the parallel magnetic field intensity can still be obtained.

Embodiments 1 to 6 describe examples in which the notch (10*n*, 11*n*) or magnetic deterioration portion (10*r*, 11*r*) is disposed on both fixed current-carrying stem 4 and moving current-carrying stem 7. However, the notch (10*n*, 11*n*) or magnetic deterioration portion (10*r*, 11*r*) may be disposed on only one of fixed current-carrying stem 4 and moving current-carrying stem 7, in which case an arc discharge can still be driven and extinguished by forming a parallel magnetic field.

Embodiments 1 to 4 describe examples in which the region on the edge portion (5*e*, 8*e*) side relative to the central portion (5*c*, 8*c*) has wings (5*w*, 8*w*). However, the region on the edge portion (5*e*, 8*e*) side relative to the central portion (5*c*, 8*c*) may have other configurations that have the effect of driving and extinguishing arc discharge.

In embodiments 1 to 4, an electrode (5, 8) has three slits (5*s*, 8*s*) dividing the outer periphery of the electrode (5, 8) into three parts, thus creating three circular segment portions (5*a*, 8*a*) and three wings (5*w*, 8*w*). Although the slits (5*s*, 8*s*) create three divisions herein, two or four or more divisions can still provide the advantageous effects. In other words, the present invention does not depend on the number of divisions.

In the present invention, the embodiments may be combined in any manner or modified or omitted as appropriate within the scope of the present invention. For example, embodiments 2 and 4 may be combined so that a moving electrode has a contact surface with a protrusion and also has a gap provided between the moving electrode and the moving magnetic body. Alternatively, embodiments 2 to 4 and 5 may be combined so that each magnetic body (10, 10A, 11, 11A) has a magnetic permeance reduction portion.

REFERENCE SIGNS LIST

4: fixed current-carrying stem; 4*f*: stem surface; 5: fixed electrode; 5*a*: circular segment portion; 5*c*: central portion; 5*e*: edge portion; 5*f*: contact surface; 5*s*: slit; 5*t*: tip; 5*w*: wing; 7: moving current-carrying stem; 7*f*: stem surface; 8, 8A: moving electrode; 8*a*: circular segment portion; 8*c*: central portion; 8*e*: edge portion; 8*f*: contact surface; 8*s*: slit; 8*w*: wing; 8*x*: protrusion; 10, 10A, 10B, 10C: fixed magnetic body; 10*n*: notch;

10*r*: magnetic deterioration portion; 10*s*: inclined portion; 10*e*: step portion; 11, 11A, 11B, 11C: moving magnetic body; 11*c*1: magnetic member; 11*c*2, 11*d*2: magnetic member; 11*n*: notch; 11*r*: magnetic deterioration portion; 13: gap; 100, 110, 120, 130: vacuum interrupter

The invention claimed is:

1. A vacuum interrupter comprising:

a moving current-carrying stem which is movable;

a moving electrode disposed at an end of the moving current-carrying stem;

a fixed current-carrying stem disposed on an extension of an axis of the moving current-carrying stem;

a fixed electrode disposed at an end of the fixed current-carrying stem and facing the moving electrode; and a magnetic body disposed on a circumferential edge around a stem surface of at least one of the moving current-carrying stem and the fixed current-carrying stem, the magnetic body including a lower magnetic permeance portion in at least a part of the magnetic body, the lower magnetic permeance portion having a lower magnetic permeance than an other portion of the magnetic body, wherein i) if the magnetic body is disposed on the moving current-carrying stem, the moving electrode has a first slit having one end point adjacent to a central portion thereof and an other end point adjacent to an edge portion thereof, the first slit dividing the moving electrode into a plurality of first circular segment portions to form a plurality of first wings, and as seen from front along the axis, the lower magnetic permeance portion of the moving magnetic body does not overlap with an end of each of the first wings of the moving electrode on an outer peripheral side, ii) if the magnetic body is disposed on the fixed current-carrying stem, the fixed electrode has a second slit having one end point adjacent to a central portion thereof and an other end point adjacent to an edge portion thereof, the second slit dividing the fixed electrode into a plurality of second circular segment portions to form a plurality of second wings, and as seen from front along the axis, the lower magnetic permeance portion of the fixed magnetic body does not overlap with an end of each of the second wings of the fixed electrode on an outer peripheral side, wherein the lower magnetic permeance portion is a groove in the magnetic body, the groove being a depression without going completely through the lower magnetic permeance portion.

2. The vacuum interrupter according to claim 1, wherein:

the magnetic body includes a first plate magnetic body and a second plate magnetic body contacting the first plate magnetic body.

3. The vacuum interrupter according to claim 1, wherein:

the magnetic body includes a magnetic permeance reduction portion at both ends or one end of the lower magnetic permeance portion, the magnetic permeance reduction portion having a reduced magnetic permeance as compared to other portion except the lower magnetic permeance portion.

4. The vacuum interrupter according to claim 3, wherein:

the magnetic permeance reduction portion is an inclined portion having an inclined surface.

5. The vacuum interrupter according to claim 3, wherein:

the magnetic permeance reduction portion is a step portion having a stepped surface.

6. The vacuum interrupter according to claim 1, wherein:

at least one of the moving electrode and the fixed electrode has a contact surface including a protrusion.

7. The vacuum interrupter according to claim 6, wherein:

the protrusion is disposed at a central portion of the contact surface of at least one of the moving electrode and the fixed electrode.

8. A vacuum interrupter comprising:

a moving current-carrying stem which is movable;

a moving electrode disposed at an end of the moving current-carrying stem;

a fixed current-carrying stem disposed on an extension of an axis of the moving current-carrying stem;

a fixed electrode disposed at an end of the fixed current-carrying stem and facing the moving electrode; and a magnetic body disposed on a circumferential edge around a stem surface of at least one of the moving current-carrying stem and the fixed current-carrying stem, the magnetic body including a lower magnetic permeance portion in at least a part of the magnetic body, the lower magnetic permeance portion having a lower magnetic permeance than an other portion of the magnetic body, wherein i) if the magnetic body is disposed on the moving current-carrying stem, a first gap is provided between the magnetic body and the moving electrode, ii) if the magnetic body is disposed on the fixed current-carrying stem, a second gap is provided between the magnetic body and the fixed electrode, a horizontal length from the center of the axis of the moving current-carrying stem to the first gap end of the moving current-carrying stem is longer than a horizontal length of a width of the first gap of the moving current-carrying stem.

the horizontal length from the center of the axis of the moving current-carrying stem to the first gap end of the moving current-carrying stem is shorter than a horizontal length of the first gap of the magnetic body, and the moving electrode has a first slit having one end point adjacent to a central portion and an other end point adjacent to an edge portion thereof, the first slit dividing the moving electrode into a plurality of first circular segment portions to form a plurality of first wings, a horizontal width of the first slit is longer than a vertical length of the first gap.

9. The vacuum interrupter according to claim 8, wherein:

the magnetic body includes a first plate magnetic body and a second plate magnetic body contacting the first magnetic plate.

10. The vacuum interrupter according to claim 8, wherein:

the magnetic body includes a magnetic permeance reduction portion at both ends or one end of the lower magnetic permeance portion, the magnetic permeance reduction portion having a reduced magnetic permeance as compared to the other portion except the lower magnetic permeance portion.

11. The vacuum interrupter according to claim 10, wherein:

the magnetic permeance reduction portion is an inclined portion having an inclined surface.

12. The vacuum interrupter according to claim 10, wherein:

the magnetic permeance reduction portion is a step portion having a stepped surface.

13. The vacuum interrupter according to claim 8, wherein:

the lower magnetic permeance portion is a notch in the magnetic body.

14. The vacuum interrupter according to claim 8, wherein:

the lower magnetic permeance portion is a groove in the magnetic body.

15. The vacuum interrupter according to claim 8, wherein:

the lower magnetic permeance portion is a first magnetic deterioration portion which is a portion of the magnetic body having a reduced magnetic permeance.

16. The vacuum interrupter according to claim 8, wherein:

at least one of the moving electrode and the fixed electrode has a contact surface including a protrusion.

17. The vacuum interrupter according to claim 16, wherein:

the protrusion is disposed at a central portion of the contact surface of at least one of the moving electrode and the fixed electrode.

18. The vacuum interrupter according to claim 8, wherein:

the lower magnetic permeance portion is a groove in the magnetic body, the groove being a depression without going completely through the lower magnetic permeance portion.

* * * * *